US010689938B2

(12) United States Patent
Beason et al.

(10) Patent No.: US 10,689,938 B2
(45) Date of Patent: Jun. 23, 2020

(54) SUBTERRANEAN FORMATION FRACKING AND WELL WORKOVER

(71) Applicant: Downing Wellhead Equipment, LLC, Oklahoma City, OK (US)

(72) Inventors: Ronnie B. Beason, Oklahoma City, OK (US); Nicholas J. Cannon, Oklahoma City, OK (US); Joel H. Young, Oklahoma City, OK (US); Brian A. Baker, Oklahoma City, OK (US); Austin C. Johnson, Oklahoma City, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 0 days.

(21) Appl. No.: 16/100,741

(22) Filed: Aug. 10, 2018

(65) Prior Publication Data

US 2019/0186226 A1 Jun. 20, 2019

Related U.S. Application Data

(60) Provisional application No. 62/598,914, filed on Dec. 14, 2017, provisional application No. 62/637,215, (Continued)

(51) Int. Cl.
*E21B 33/068* (2006.01)
*E21B 43/26* (2006.01)
(Continued)

(52) U.S. Cl.
CPC ..... *E21B 33/068* (2013.01); *E21B 34/02* (2013.01); *E21B 43/26* (2013.01); *E21B 2034/005* (2013.01)

(58) Field of Classification Search
CPC ..... E21B 33/068; E21B 34/02; E21B 43/26; E21B 2034/005
See application file for complete search history.

(56) References Cited

U.S. PATENT DOCUMENTS 4,053,594 A 12/1977 Canterbury
4,063,594 A 12/1977 Canterbury
(Continued)

FOREIGN PATENT DOCUMENTS

WO 2014147032 9/2014
WO WO2014147032 9/2014

OTHER PUBLICATIONS

International Search Report and Written Opinion issued in International Application No. PCT/US2018/65341 dated Mar. 15, 2019, 13 pages.

(Continued)

*Primary Examiner* — James G Sayre
(74) *Attorney, Agent, or Firm* — Fish & Richardson P.C.

(57) ABSTRACT

While a fracturing stack on a well is at fracturing pressure, receiving a perforating string in a section of the center bore of the fracturing stack. The section is a section above a fracturing head of the fracturing stack. While the fracturing stack is at fracturing pressure, sealing the section of the center bore to maintain a fracturing pressure in and below the fracturing head. Equalizing pressure in the section to atmospheric pressure. Receiving, at atmospheric pressure, a well drop in the section. Equalizing pressure in the section to pressure in the fracturing stack below the section. Releasing the well drop into the center bore of the fracturing head and to the well.

25 Claims, 17 Drawing Sheets

Related U.S. Application Data filed on Mar. 1, 2018, provisional application No. 62/638,681, filed on Mar. 5, 2018, provisional application No. 62/637,220, filed on Mar. 1, 2018, provisional application No. 62/638,688, filed on Mar. 5, 2018.

(51) Int. Cl.
*E21B 34/02* (2006.01)
*E21B 34/00* (2006.01)

(56) References Cited

U.S. PATENT DOCUMENTS 4,457,376 A 7/1984 Carmody et al.
5,996,695 A 12/1999 Koleilat et al.
6,065,542 A 5/2000 Lalor et al.
6,095,242 A 8/2000 Lequang et al.
6,170,573 B1 1/2001 Brunet et al.
6,227,299 B1 5/2001 Dennistoun
6,805,200 B2 10/2004 DeBerry
7,134,490 B2 11/2006 Nguyen
8,196,649 B2 6/2012 Allen et al.
8,261,837 B2 9/2012 Leonard et al.
8,424,607 B2 4/2013 Springett et al.
8,479,824 B2 7/2013 Travis et al.
8,511,393 B2 8/2013 Nguyen
8,668,020 B2 3/2014 Guitierrez et al.
8,960,276 B2 2/2015 Lang et al.
9,038,712 B1 5/2015 Streety et al.
9,085,950 B2 7/2015 Spacek
9,464,496 B2 10/2016 O Rourke et al.
RE46,241 E 12/2016 Cain et al.
9,534,465 B2 1/2017 Nguyen et al.
9,702,211 B2 7/2017 Tinnen
9,745,816 B2 8/2017 Milne et al.
2002/0185276 A1* 12/2002 Muller ..... E21B 33/068 166/297
2006/0124314 A1 6/2006 Haheim et al.
2007/0227743 A1 10/2007 Dallas
2008/0029262 A1 2/2008 Claxton
2008/0087439 A1* 4/2008 Dallas ..... E21B 33/03 166/379
2008/0173441 A1 7/2008 Bowles et al.
2008/0277122 A1 11/2008 Tinnen
2012/0152564 A1 6/2012 Peltier
2013/0098632 A1 4/2013 Wetzel et al.
2013/0284432 A1 10/2013 MacPhail et al.
2014/0048255 A1 2/2014 Baca et al.
2014/0158380 A1 6/2014 Varkey et al.
2014/0196906 A1 7/2014 Elenburg et al.
2014/0360720 A1 12/2014 Corbeil
2016/0290087 A1* 10/2016 Cherewyk ..... E21B 33/068
2017/0101840 A1 4/2017 Kauffmann et al.
2017/0204702 A1 7/2017 Hansen
2017/0298708 A1* 10/2017 Cannon ..... E21B 34/101

OTHER PUBLICATIONS

International Search Report and Written Opinion; PCT/US2017/027687 dated Sep. 8, 2017, 17 pages.

* cited by examiner

SUBTERRANEAN FORMATION FRACKING AND WELL WORKOVER

TECHNICAL FIELD

The present disclosure relates to fracking and well workover operations.

BACKGROUND

A subterranean formation surrounding a well may be fractured to improve communication of fluids through the formation, for example, to/from the well. The fracturing is often performed in stages, where a segment or interval of the well is fractured, the interval is sealed off, and then a subsequent interval fractured. The intervals are sealed by setting a plug that seals the bore of the well below a certain depth or by shifting a frac sleeve that seals the perimeter of the well from communication with the surrounding formation. The frac sleeves are typically shifted using various sized frac balls, collets or other similar devices dropped from the surface into the well as the fracturing fluid is pumped. The ball, collet or other device lands on a corresponding profile of the sleeve and causes it to shift close. Also, in completion and workover operations, tools are extended into the well under pressure on wireline or coiled tubing to perform various operations, such as perforating the well casing.

DESCRIPTION OF DRAWINGS

FIG. 2A shows the fracturing stack with a blowout preventer (BOP) and lubricator. FIG. 2B shows the fracturing stack in half cross sectional view. FIG. 2C shows the fracturing stack with the BOP and lubricator removed.

FIG. 7A is a half cross-sectional view with the flapper valve closed. FIG. 7B is a half cross-sectional view taken orthogonally to the section of FIG. 7A. FIG. 7C is the same cross-section as FIG. 7A with the flapper valve open.

FIG. 8A is a half cross-sectional view with the flapper valve closed. FIG. 8B is a half cross-sectional view taken orthogonally to the section of FIG. 8A. FIG. 8C is the same cross-section as FIG. 8A with the flapper valve open.

Like reference symbols in the various drawings indicate like elements.

DETAILED DESCRIPTION

Figure 1:
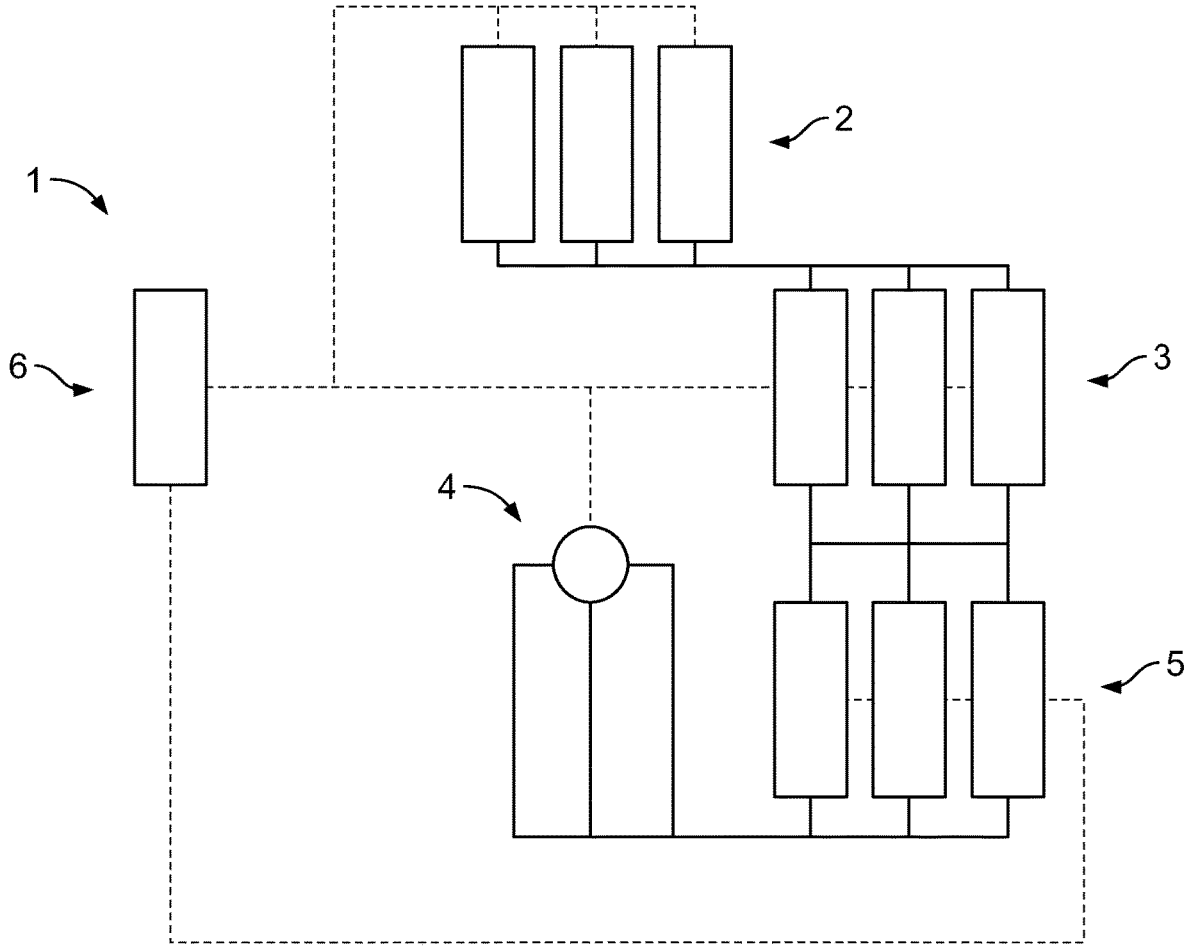
FIG. 1 is a schematic diagram of an example well fracking site.

FIG. 1 is a schematic diagram of an example well site 1 arranged for fracking. The well fracking site 1 includes tanks 2. The tanks 2 hold fracking fluids, proppants, and/or additives that are used during the fracturing process. The tanks 2 are fluidically coupled to one or more blenders 3 at the well site 1 via fluid lines (e.g., pipes, hoses, and/or other types of fluid lines). The blenders mix the fracking fluids, proppants, and/or additives being used for the fracking operation prior to being pumped into the well 4. The blenders are fluidically coupled to one or more fracking pumps 5 via lines. The fracking pumps increase the pressure of the blended fracking fluid to fracking pressure (i.e., the pressure at which the target formation fractures) for injection into the well 4. A data van 6 is electronically connected to the tanks 2, the blenders 3, the well 4, and the fracking pumps 5. The data van 6 includes a controller that controls and monitors the various components at the well site 1. While a variety of components have been described in the example well site 1, not all of the described components need be included. In some implementations, additional equipment may be included. Also, the well 4 can be an onshore or offshore well. In the case of an offshore well, including subsea wells and wells beneath lakebeds or other bodies of water, the well site 1 is on a rig or vessel or may be distributed among several rigs or vessels.

Figure 2A:
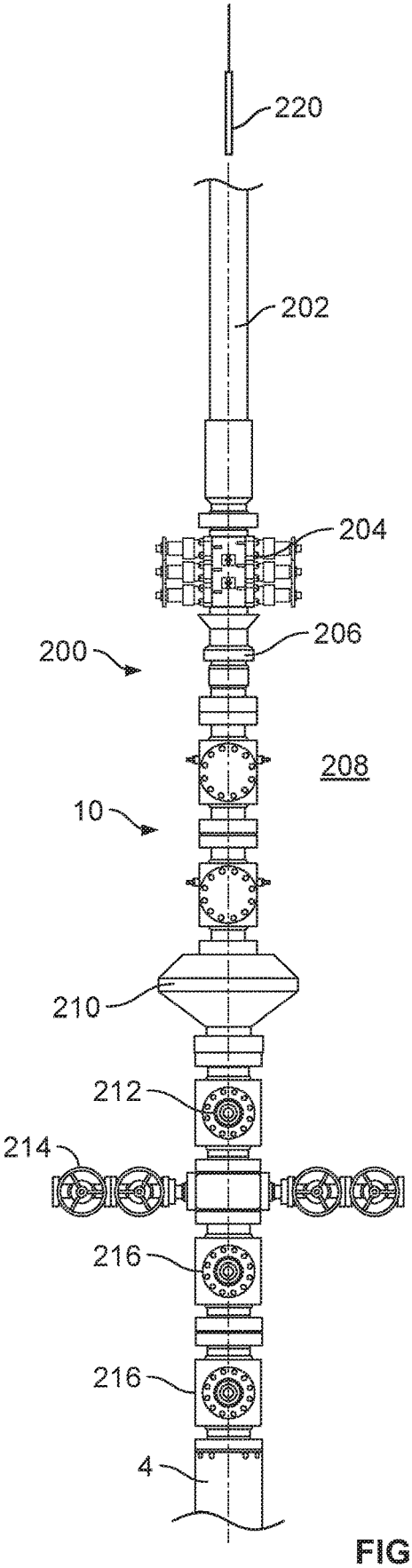
FIGS. 2A-2C are side views of an example fracturing stack that can be used with aspects of this disclosure.
Figure 2B:
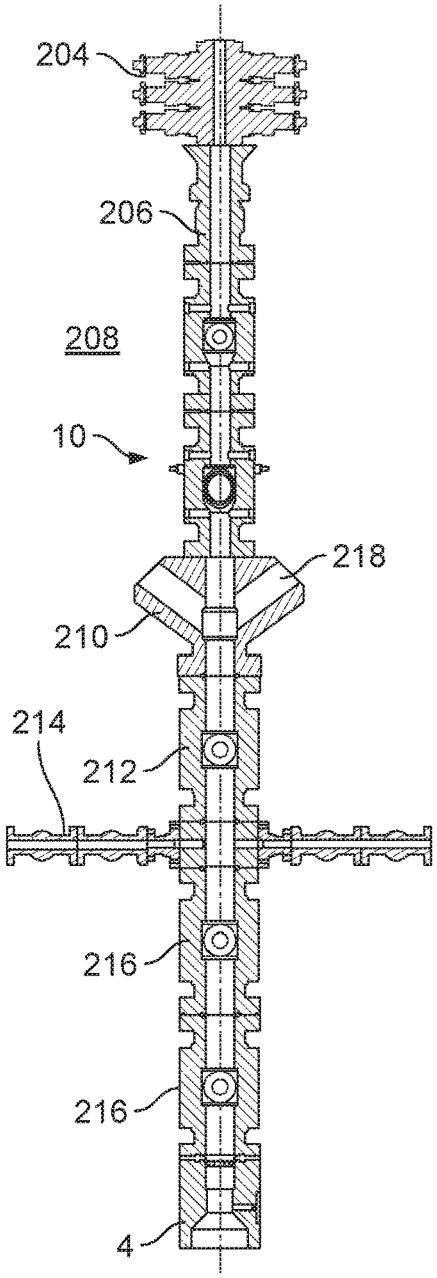
Figure 2C:
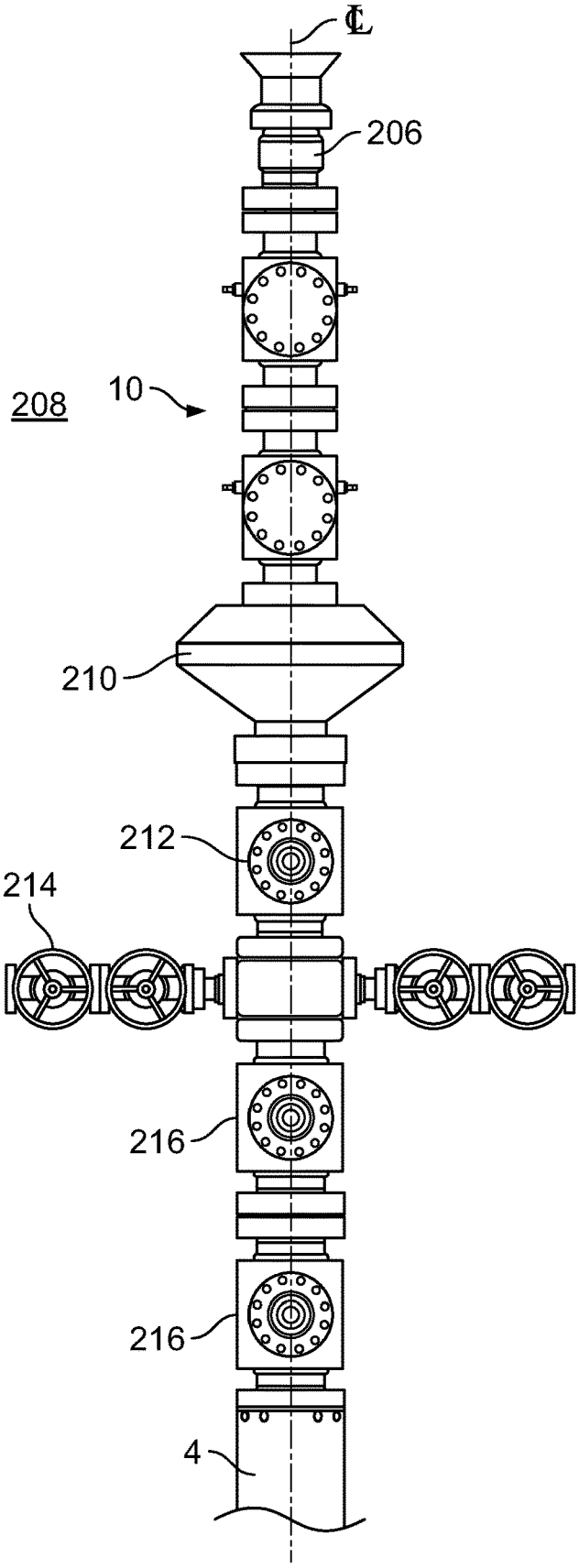

During fracking operations, various components are stacked atop the well 4. FIGS. 2A-2C illustrate, at various stages of operation, an example fracturing stack 200 attached at a wellhead of the well 4. FIG. 2A shows a fracturing stack 200 with a lubricator 202 positioned at the top. The lubricator 202 carries a wireline or coiled tubing deployed tool above a tool trap of or associated with the lubricator. The tool trap is actuable in response to a signal (e.g., hydraulic, electric, and/or other signal) to gate passage of the tool from the lubricator. The lubricator is a tool that maintains a seal around the wireline or coiled tubing while the tool is being run into the well 4. In the present example, the lubricator 202 internally carries a perforating string 220, including one or more perforating guns for perforating the wall of the wellbore and, often, a positioning tool, such as a casing collar locator and/or logging tool. In other examples, the lubricator 202 can carry other types of tool strings, such as logging tools, packoff tools, and other types of wireline or tubing deployed tools.

The lubricator 202 sits above a blowout preventer (BOP) 204. The BOP 204 is configured to seal off the well in the event of a kick or blowout. The BOP 204 is able to shear any tool or conveyance that may be positioned within the well during such an event. An automated latch 206 is below the BOP 204. The latch 206 operates in response to a signal (e.g., hydraulic, electric, and/or other) to grip and seal to (i.e., latch to) or open and release a mating hub. By providing the mating hub on the BOP 204, the latch 206 acts as a quick release that allows the BOP 204 and lubricator 202 to be installed and removed quickly without intervention of a worker, for example, to access and bolt/unbolt the BOP 204 from the remainder of the fracturing stack 200. In some instances, the latch 206 can be omitted from the fracturing stack 200 and the BOP bolted/unbolted from the remainder of the stack.

A valve assembly 10 is below the latch 206. The valve assembly 10 can include a single or dual part body. The valve assembly 10 is actuable in response to a signal (e.g., hydraulic, electric and/or other) to isolate or seal the well (i.e., seal the bore through the fracturing stack 200) from any components positioned above the valve assembly 10, such as the lubricator 202, BOP 204, or the atmosphere 208. Structural details of the valve assembly 10 are described in greater detail later within this disclosure. Below the valve assembly 10 is a fracturing manifold 210, sometimes referred to as a goat head or frac head. The fracking pumps 5 are fluidically connected by lines to the fracturing stack 200 through the frac head 210. In certain instances, a swab valve 212 can be provided above or below the frac head 210 that can be used to isolate/access the well, for example for maintenance. Below the swab valve 212 are wing valves 214. The wing valves 214 can be used for a variety of wellbore operations, such as purging the well 4. Below the wing valves are one or more main valves 216 configured to seal the well 4, including as the fracturing stack 200 is assembled, disassembled, and/or maintained. While a variety of components have been described in the fracturing stack, not all of the described components need be included. In some implementations, additional equipment, such as additional main valves 216, may be included. Also, although shown as separate components, two or more of the components of the fracturing stack 200 could be integrated. For example, in certain instances, the frac head 210 and valve assembly 10 may be integrated together, e.g., constructed with a common housing or otherwise configured to attach/detach from the fracturing stack 200 as a unit. Other combinations of components could likewise be integrated.

The valve assembly 10, when closed, seals to maintain pressure on and below the frac head 210 and any equipment fluidically connected to the frac head 210, for example the fracking equipment at the well site 1, including pumps 5, the blenders 3, any lines fluidically connecting such equipment. Such isolation allows the BOP 204 and lubricator 202 to be removed, reinstalled, or maintained without depressurizing the well 4 or fracturing equipment on well site 1. As explained in more detail below, such isolation also allows the top of the fracturing stack 200 to be opened and accessed at atmospheric conditions, for example, to insert a tool on wireline or tubing or a well drop (e.g., frac ball, collet, dart, or other) or other item into the well 4. Every time the fracturing stack 200 and fracturing equipment at the well site 1 is depressurized, it needs to be re-pressure tested prior to commencing operations. In some instances, this can take several hours, and in multi-stage fracturing, cumulatively days In multi-stage fracturing operations, where equipment is added and removed from the top of the fracturing stack 200 multiple times, maintaining pressure on the system between operations can save several days at a well site.

FIG. 2B shows a cross-sectional view of the fracturing stack 200. Once assembled, the fracturing stack has a central flow path, or main bore, extending through the center of the stack. The frac head 210 includes lateral fluid injection paths 218 where the fracking pumps 5 are fluidically connected for injecting frac fluids into the main bore and, in turn, into the well 4 during a fracturing treatment. The valve assembly 10 sits above the frac head 210 and includes two valves capable of isolating the frac head 210 and fracturing stack 200 below from any equipment located above the valve assembly 10. For example, fracturing stack 200 can be pressurized and tested for perforation operations. In such a situation, the BOP 204 and lubricator 202 are installed to lower the perforating string 220 into the wellbore. After the perforation operation is complete, a frac ball can be dropped into the well. In such an instance, the valve assembly 10 is closed and all of the components above the valve assembly are depressurized. In some instances, the BOP may remain in place. In other instances, the BOP can be removed, such as in FIG. 2C. In either instance, the fracturing stack 200 is still pressurized below the valve assembly 10.

After the well 4 is completed, or in a workover operation of the well 4, the fracturing stack 200 is used in fracturing the subterranean formation surrounding the well 4. While more details of the operation of the fracturing stack 200 will be described below, in general, in a fracturing operation, fracturing fluids containing proppant are pumped to the frac head 210 from the blenders and pumps at the well site 1. The fracturing stack 200 can be in either configuration of FIG. 2A or 2C and valve assembly 10 is closed, sealing the central bore of the fracturing stack 200 above the fracturing head 210. The fracturing fluids pass into the frac head 210, down the central bore of the fracturing stack 200 and the well 4, and out of a perforated or slotted interval of the well 4 into the subterranean formation. The fracturing fluids are at fracturing pressure, meaning the rate and pressure of the fracturing fluids cause the subterranean formation at that interval to expand and fracture.

In a multi-stage fracturing operation, the well 4 is perforated and then fracked in another interval. A lubricator 202 containing a perforating string 220 is used in conducting the perforating operation. If, upon completion of the first stage fracturing, the fracturing stack 200 is configured as in FIG. 2C without a lubricator 202, the latch 206 is operated to receive the BOP 204 with the lubricator 202 as shown in FIG. 2A. The valve assembly 10 is then used (as discussed in more detail below) to bring the BOP 204 and lubricator 202 up to pressure without needing to lower the pressure in the fracturing stack 200 below the fracturing head 210. The perforating string 220 can then be lowered through the valve assembly 10 into the well 4, and operated to perforate the wall of the wellbore at another specified interval. The perforating string 220 is withdrawn back to the lubricator 202 and the valve assembly 10 closed to isolate the lubricator 202 from pressure in the remaining portion of the fracturing stack 200.

The valve assembly 10 is then used (as described in more detail below) to depressurize a top portion of the fracturing stack 200 for removing the lubricator 202 from the fracturing stack 200 (resulting in the configuration of FIG. 2C) and in introducing a well drop from atmospheric conditions in the environment surrounding the fracturing stack 200 into the center bore of the well 4 without needing to lower the pressure in the fracturing stack 200 below the valve assembly 10 or in the surface equipment (e.g., blenders, frack pumps, associated lines, and/or other surface equipment). The well drop can be released using a launcher (e.g., a single or multi ball, collet, dart launcher, and/or another type of launcher) on the fracturing stack 200 or by hand, manually inserting the well drop into the top of the stack 200 above the valve assembly 10. When release from the valve assembly 10, the well drop travels through the well 4, landing on a specified profile internal to the well 4 to isolate the fractured interval from the remaining portion of the well, for example, by shifting a frac sleeve or sealing off the central bore. Once the fractured interval is isolated, the next fracturing stage is begun.

Figure 3:
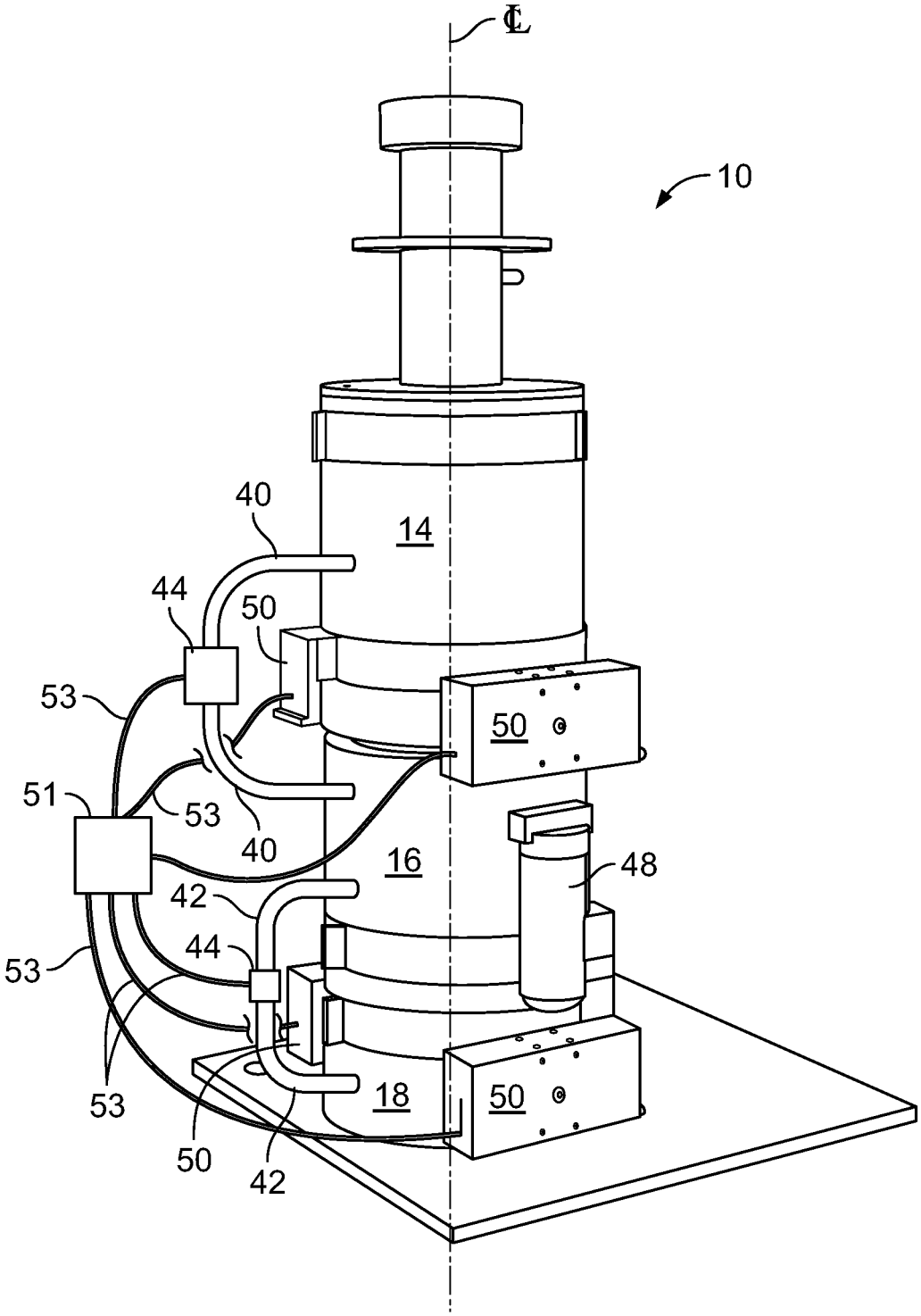
FIG. 3 is a side elevation view of an example valve assembly constructed in accordance with the present disclosure.

FIG. 3 shows one example of a valve assembly 10. The valve assembly 10 includes connectors (e.g., flange or other type of connector), top and bottom, for connecting to other components of the fracturing stack. The valve assembly 10 can also include a first, or top, operating volume 14 near an upper end of the assembly 10 that can be isolated from the remainder of the valve assembly 10 to enable the area 14 to be maintained at a lower pressure (e.g., atmospheric pressure) than the remainder of the valve assembly 10. The first operating volume 14 can thus be in fluid communication with whatever is disposed above it via an opening at the top end of the central bore through the valve assembly 10.

The valve assembly 10 further includes a second intermediate, or load lock, operating volume 16 disposed adjacent to the first operating volume 14. A third, or bottom, operating volume 18 is disposed adjacent to a second operating volume 16 on an opposite side of the second operating volume 16 from the first operating volume 14. Each operating volume 14, 16, and/or 18 can be sealed from the others to contain fluid at different pressures.

Figure 4:
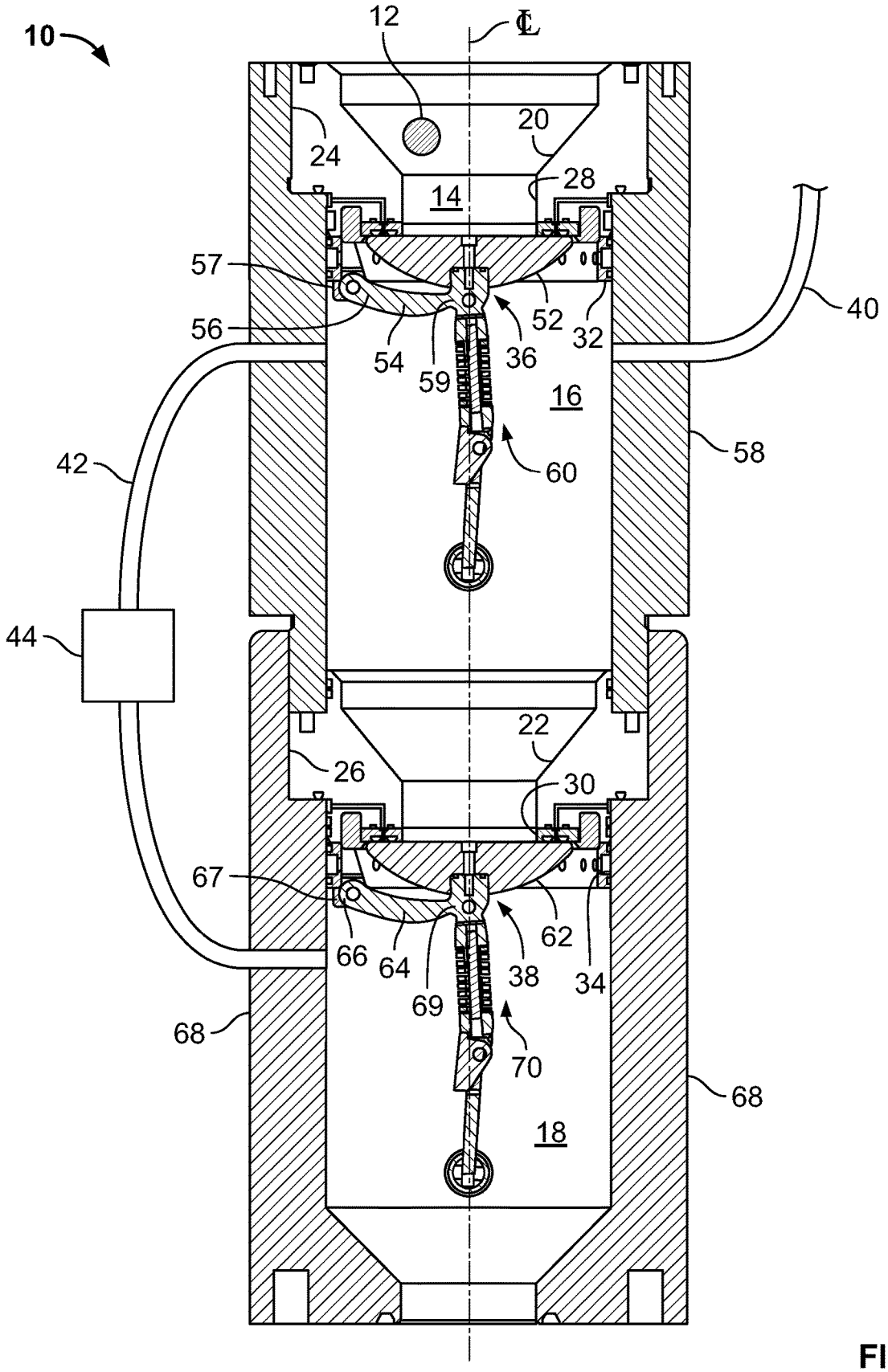
FIGS. 4-6 are half cross-sectional views of the example valve assembly of FIG. 3 in various stages of operation.

FIG. 4 is a side half cross-sectional view of the example valve assembly 10. The first operating volume 14, the second operating volume 16, and/or the third operating volume 18 can each include a downwardly oriented frustoconical funnel that works to direct a well drop 12, such as a well drop or well tool, being passed therethrough to the center bore in each respective operating volume. A first funnel 20 is disposed in an upper part of the first operating volume 14. A second funnel 22 is disposed in an upper part of the second operating volume 16. A third funnel element is disposed in an upper part of the third operating volume 18.

The valve assembly 10 is designed to use the fluid pressure in the third operating volume 18 to pressurize the second operating volume 16 and the pressure in the second operating volume 16 to pressurize the first operating volume 14. The valve assembly 10 is also designed to reduce pressure of the second operating volume 16 by bleeding to the atmosphere or to the first operating volume 14.

The valve assembly 10 further includes a first valve 36 that separates the first operating volume 14 from the second operating volume 16 and a second valve 38 that separates the second operating volume 16 from the third operating volume 18. The first operating volume 14 can be a space that is defined by the area between the first valve 36 and any apparatus disposed atop the valve assembly 10. To pass the well drop 12 through the valve assembly 10, the pressure of the fluid in the second operating volume 16 is adjusted to be within a specified maximum pressure differential from the fluid in the first operating volume 14. Adjusting the pressure of the fluid in the second operating volume 16 allows the first valve 36 to open up and permit the well drop 12 disposed in the first operating volume 14 to pass into the second operating volume 16. The second operating volume 16 can be sized such that the well drop 12 can be contained therein without affecting the operation of the first valve 36. For example, the second operating volume 16 could be smaller when the well drop 12 is a frac ball and it would be larger (taller/longer) if the well drop 12 was a collet.

When the pressure of the fluid in the second operating volume 16 is beyond the specified maximum pressure differential from the fluid in the first operating volume 14, the first valve 36 cannot be opened by operation of the valve assembly 10. In certain instances, the maximum pressure differential is implemented in the operation of system, for example, by the configuration (e.g., strength or other characteristic) of the valve actuator, hydraulic areas, by control interlocks coupled with pressure sensors on either side of first valve 36 (to measure pressure in the first and second operating volumes 14, 16) or in another manner, and specified to prevent unintentional opening of the first valve 36, damage to the valve assembly 10 and other nearby equipment, and/or an otherwise unsafe condition.

To pass the well drop 12 from the second operating volume 16 into the third operating volume 18, the pressure of the fluid in the second operating volume 16 is increased to be within a specified maximum pressure differential from the fluid in the third operating volume 18. Once the pressure of the fluid in the second operating volume 16 is within the specified maximum pressure differential from the fluid in the third operating volume 18, the second valve 38 will open and permit the well drop 12 to pass from the second operating volume 16 into the third operating volume 18.

Similar to operation of the first valve 36, when the pressure of the fluid in the third operating volume 18 is outside of the specified maximum pressure differential from the fluid in the second operating volume 16, the second valve 38 cannot be opened by the operation of the valve assembly 10. As above, the specified maximum pressure differential used with the second valve 38 can be implemented, for example, by the configuration (e.g., strength or other characteristic) of the valve actuator, hydraulic areas, by control interlocks coupled with pressure sensors measuring on either side of second valve 38 (to measure pressure in the second and third operating volumes 16, 18) or in another manner, and specified to prevent unintentional opening of the second valve 38, damage to the valve assembly 10 and other nearby equipment, and/or an otherwise unsafe condition. Also, the specified maximum pressure differential used with the first valve 36 and second valve 38 need not be the same. Logic can be built into a controller that controls the operation of the first valve 36 and second valve 38, which prevents the opening of the first valve 36 and the second valve 38 if the pressure across either valve 36, 38 is beyond its respective specified maximum differential.

To run a tool on wireline or tubing through the valve assembly 10 during operating conditions (i.e., high-pressure conditions), the first valve 36 and the second valve 38 must be in an open position simultaneously. For the first valve 36 and the second valve 38 to be open, the pressure of the fluid in the first operating volume 14 and the second operating volume 16 can be adjusted to be within the specified maximum pressure differential with the pressure of the fluid in the third operating volume 18. This allows the first valve 36 and the second valve 38 to open up and permit the tool to pass through the valve assembly 10. In certain instances, the first valve 36 and the second valve 38 can be a type of valve that cannot shear the wireline or tubing during operation, such as flapper valves and the like. Other valves, such as plug valves, gate valves, and ball valves can be used with appropriate interlocks to prevent sheering of the wireline or tubing. That is, the first valve 36 and the second valve 38 can be any type of valve that can make contact with the tool or its conveyance without damaging it.

In some implementations, when wanting to pass a tool through the valve assembly 10, the first valve 36 is in a closed position and the pressure of the fluid in the second operating volume 16 can be increased to be within the specified maximum pressure differential with the fluid in the third operating volume 18, so the second valve 38 can open. In this scenario, the pressure of the fluid in the first operating volume 14 will then be increased to be within the specified maximum pressure differential with the fluid in the second operating volume 16, so the first valve 36 can open. The pressure of the fluid in the first operating volume 14 will dictate the pressure in the fracturing stack above, since the two are in fluid communication. Once the first valve 36 and the second valve 38 are open, the tool is permitted to pass all of the operating volumes and into the well.

In some instances, the first valve 36 is in an open position and the second valve 38 is in a closed position when it is desirable for the valve assembly 10 to be used in passing a tool. The fluid in the first operating volume 14 and the second operating volume 16 is increased within the specified maximum pressure differential with the fluid in the third operating volume 18, the second valve 38 can open, which would permit the tool to be extended into and through the valve assembly 10. Conversely, the second valve 38 can be in an open position and the first valve 36 is in a closed position when it is desirable for the valve assembly 10 to be used in passing a tool. In this instance, the fluid in the first operating volume 14 is increased within the specified maximum pressure differential with the fluid in the second operating volume 16, and the third operating volume 18, the first valve 36 can open, which permits the tool to be extended into and through the valve assembly 10. It should be understood and appreciated that each operating volume 14, 16, and/or 18 can be pressured up or down in numerous ways.

In certain situations, the pressure of the fluid in the third operating volume 18, because it is exposed to well conditions, is dynamic and may be fluctuating in such a manner whereby the fluid pressure in the second operating volume 16 cannot reach the substantially same pressure as the dynamic pressure of the fluid in the third operating volume 18 for a sufficient amount of time to open the second valve 38. In some implementations, to combat this dynamic fluid pressure issue, the valve assembly 10 can include an external pump 48 (FIG. 3) in fluid communication with the second operating volume 16 to increase the pressure of the fluid in the second operating volume 16 to a sufficient pressure to overcome the dynamic pressure of the fluid in the third operating volume 18 for a sufficient amount of time and permit the second valve 38 to open. The external pump 48 can be any type of pump capable of achieving the required fluid pressures, for example, a triplex plunger pump or a diaphragm pump.

The valve assembly 10 can include a first port disposed in the body of the valve assembly 10 that fluidically connects the third operating volume 18 with a first end of a first equalizing conduit 42. The first conduit 42 extends from the first port to a second port disposed in the body of the valve assembly 10 that fluidically connects the second operating volume 16 to a second end of the first conduit 42. The valve assembly 10 can also include a third port disposed in the body of the valve assembly 10 that fluidically connects the second operating volume 16 with a first end of a second equalizing conduit 40. The second conduit 40 extends from the third port to a fourth port disposed in the body of the valve assembly 10 that fluidically connects the first operating volume 14 to a second end of the second conduit 40. In some implementations, the valve assembly 10 can include a third conduit that fluidically connects the third operating volume 18 to the first operating volume 14. The first operating volume 14 and third operating volume 18 can include additional ports to facilitate this fluid connection or the third conduit can be tied into the first conduit 42 on one end, where the first conduit 42 comes out of the third operating volume 18 and ties into the second conduit 40 on the other end, where the second conduit 40 comes out of the first operating volume 14. Equalizing valves 44 (e.g., sealing valve, flow diverters, and/or other fluid flow control devices) can be incorporated into or in fluid communication with the conduits direct fluid to flow to the appropriate conduits to accomplish the desired operation of the valve assembly 10. The equalizing valves 44 can be actuable types, actuable to open/close in response to a signal (e.g., hydraulic, electric and/or other) and can include multiple devices for redundancy and safety.

To manage the pressure of the fluid in the second operating volume 16, the first conduit 42 that fluidically connects the second operating volume 16 to the third operating volume 18 can be used to increase the pressure of the fluid in the second operating volume 16. The associated valve can be activated to permit the fluid at a higher pressure in the third operating volume 18 to flow into the second operating volume 16 in order to increase the pressure of the fluid in the second operating volume 16 via the first conduit 42. The second conduit 40 that fluidically connects the second operating volume 16 to the first containment can be used to increase the pressure of the fluid in the first operating volume 14 or decrease the pressure of the fluid in the second operating volume 16. In some implementations, the associated valve can be activated to permit the fluid at a higher pressure in the second operating volume 16 to flow into the first operating volume 14 in order to increase the pressure of the fluid in the first operating volume 14. In some implementations, the associated valve can be activated to permit the fluid at a higher pressure in the second operating volume 16 to flow into the first operating volume 14 in order to decrease the pressure of the fluid in the second operating volume 16 via the first conduit 42.

The valve assembly 10 can also include a first vent fluidically connected to the first operating volume 14 to bleed pressure from the first operating volume 14 when it is desirable to decrease the pressure of the fluid therein. The valve assembly 10 can also include a second vent fluidically connected to the second operating volume 16 to bleed pressure from the second operating volume 16. The first vent can be a separate port in fluid communication with the first operating volume 14. In another implementation, the first vent can use the fourth port disposed in the body of the valve assembly 10, the second conduit 40 or third conduit, and any appropriate valves, flow diverters, fluid flow control devices, and the like to bleed pressure from the first operating volume 14. The second vent can be a separate port in fluid communication with the second operating volume 16. In another implementation, the second vent can use the second port or the third port disposed in the body of the valve assembly 10, the first conduit 42 or second conduit 40, and any appropriate valves, flow diverters, fluid flow control devices, and the like to bleed pressure from the second operating volume 16.

In one implementation, the second operating volume 16 can be positioned below the first operating volume 14 and the third operating volume 18 can be positioned below the second operating volume 16. This orientation allows the well drop 12 being passed through the valve assembly 10 or the tool to pass downward through the valve assembly 10.

A first opening 28 is disposed in the bottom of the first end 24 of the first operating volume 14 (or at the upper end 32 of the second operating volume 16 or between the first operating volume 14 and the second operating volume 16) so that the well drop 12 being passed through the valve assembly 10 or the downhole tool passed into the first operating volume 14 can pass into the second operating volume 16. Similarly, a second opening 30 is disposed in the lower end 26 of the second operating volume 16 (or at the upper end 34 of the third operating volume 18, or between the second operating volume 16 and the third operating volume 18) so that the well drop 12 being passed through the valve assembly 10 or the downhole tool passed into the second operating volume 16 from the first operating volume 14 can pass into the third operating volume 18.

In one implementation, the first valve 36 and second valve 38 can be flapper valves, oriented to open into the second and third operating volumes 16, 18, so the higher pressure of the fluid in the second operating volume 16 over the pressure of the fluid in the first operating volume 14 acts on the flapper to maintain the closure of the first valve 36 and the higher pressure of the fluid in the third operating volume 18 over the pressure of the fluid in the second operating volume 16 acts on the flapper to maintain the closure of the second valve 38. Further, the first valve 36 and second valve 38 can be opened and closed by an actuator 50. The actuator 50 can be any type of actuator 50 known in the art. Examples include, but are not limited to, a pneumatic actuator, a hydraulic actuator, an electrical actuator, an air-over hydraulic actuator, a manual screw actuator, or manual lever actuator. The first valve 36 and the second valve 38 can be driven by a single actuator or multiple actuators. The actuators can be controlled by the controller 51.

In some implementations, the valve assembly 10 is designed to not destroy the wireline or tubing that are in the valve assembly 10 during operation, even by an accidental activation of the first valve 36 and/or the second valve 38. The valve assembly 10 is designed so that the first valve 36 must fully close before the second valve 38 will close. If the first valve 36 does not fully close, then the second valve 38 will not close. The first valve 36 can be designed such that it will close at a predetermined speed or force and will continue to close unless the first valve 36 meets some form of resistance before the first valve 36 is completely closed. If the tool string is running through the valve assembly 10, then the first valve 36 will contact it, which provides resistance to the first valve 36 prior to the first valve 36 being fully closed, but not contact it with such force that the wireline or tubing is destroyed or damaged (e.g., severed). The operation above can be implemented via control logic in the controller 51 and/or by physical configuration of the valve assembly 10 (e.g., by sizing of the valve actuators and hydraulic areas or by providing a slip clutch between each valve and its actuator). In some implementations, the controller 51 can receive signals from various sensors and create an interlock if an object is detected by the sensors. Such an interlock prevents the actuators from moving and potentially damaging the wireline, tubing or tool string. Sensors can include optical sensors, position sensors, current sensors, torque sensors, or any other type of sensor that can be used to determine the presence of an obstruction, such as the wireline, tubing or tool string. For example, in some implementations, current sensors can be provided on the actuators. A larger than normal current draw during actuation (i.e., above a specified threshold current) can indicate that there is an object within the valve assembly 10. The actuator 50 can then feed that data back to the controller 51, which can deactivate the actuator 50 in response to the data. In other examples, similar results can be achieved with torque sensors on the actuators (e.g., when torque to move the flappers is above a specified threshold torque) or pressure sensors on hydraulic lines of the actuators (e.g., pressure to move flappers with a hydraulic actuator is above a specified threshold pressure).

In some implementations, the position of the actuator 50 for the first valve 36 and/or second valve 38 can be monitored to determine where resistance begins for the first valve 36 and/or second valve 38. The actuator 50 for the first valve 36 and/or second valve 38 can also have a lower force to close the valves so that if resistance occurs before the first valve 36 and/or second valve 38 is completely closed, the actuator 50 will stop forcing the first valve 36 and/or the second valve 38 to close. The valve assembly 10 may also be equipped with an indicator to notify an operator that the first valve 36 and/or second valve 38 could not close, which alerts the operator that the tool string is in the valve assembly 10. This also prevents the other valve from closing and damaging the tool string. Feedback from the first valve 36 and/or the second valve 38 or the actuator 50 controlling the first valve 36 and/or the second valve 38 can be connected mechanically or electronically.

Figure 5:
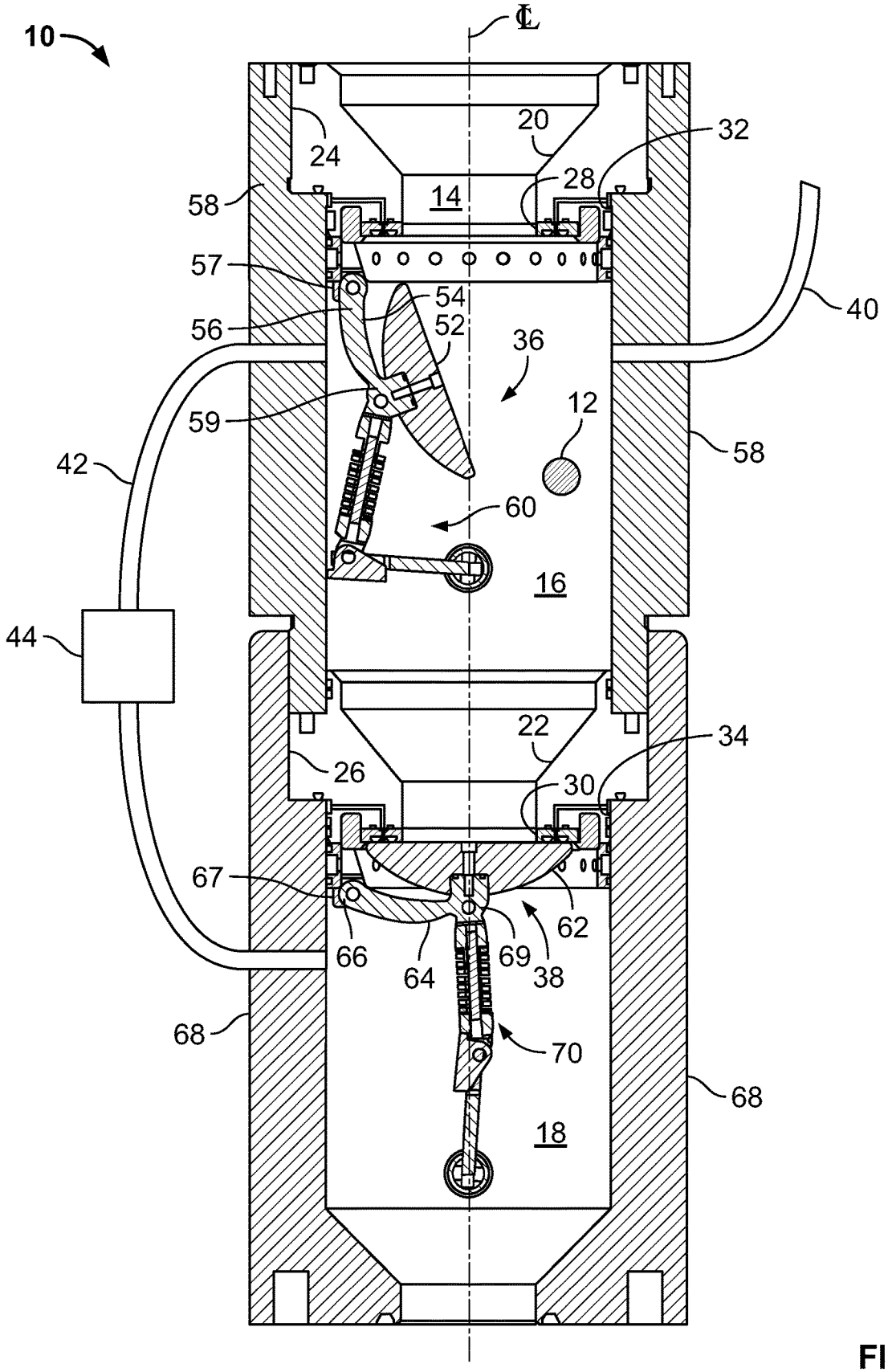

FIG. 5 is a side half cross-sectional view of the example valve assembly 10 with the first flapper 52 in the open position. When it is desirable to pass the well drop 12 through the valve assembly 10, the well drop 12 is delivered into the first operating volume 14. To pass the well drop 12 from the first operating volume 14 to the second operating volume 16, pressure of the fluid in the second operating volume 16 has to be decreased (or potentially increased in certain circumstances) to essentially the same pressure as the pressure of the fluid in the first operating volume 14 (the low pressure area). To facilitate this, the equalizing valve is manipulated to permit fluid from the second operating volume 16 to flow through the second conduit 40 and into the first operating volume 14. Permitting fluid to flow through the second conduit 40 from the second operating volume 16 into the first operating volume 14 results in the pressure of the fluid in the second operating volume 16 being decreased to substantially the same pressure as the pressure of the fluid in the first operating volume 14. During the operation, permitting the well drop 12 to flow from the first operating volume 14 into the second operating volume 16, the second valve 38 is in the closed position.

Figure 6:
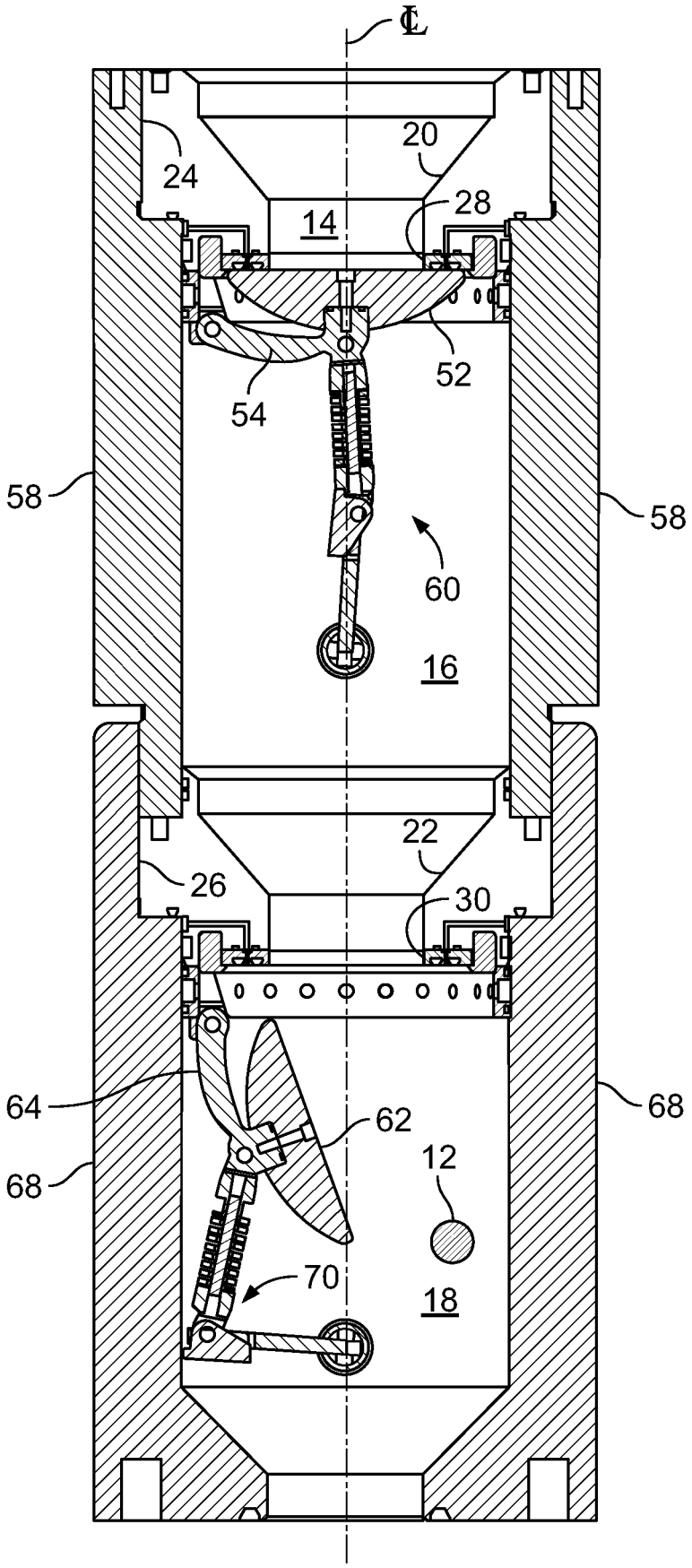

FIG. 6 is a side half cross-sectional view of the example valve assembly 10 with the second flapper 62 in the open position. When it is desirable for the well drop 12 to flow from the second operating volume 16 to the third operating volume 18, pressure of the fluid in the second operating volume 16 has to be increased to essentially the same pressure as the pressure in the fluid in the third operating volume 18 (the high-pressure system). To facilitate this, the appropriate equalizing valve is manipulated to permit fluid from the third operating volume 18 to flow through the first conduit 42 and to the second operating volume 16. Permitting fluid to flow through the first conduit 42 from the third operating volume 18 into the second operating volume 16 results in the pressure of the fluid in the second operating volume 16 being increased to substantially the same pressure as the pressure of the fluid in the third operating volume 18. During the operation, permitting the well drop 12 to flow from the second operating volume 16 into the third operating volume 18, the first valve 36 is in the closed position.

In some implementations, the first valve 36 includes a flapper 52, and a pivot arm 54 supported on one end to a rod 72 (FIG. 7A) that is rotationally disposed in the valve body and extends through the valve body. The operation of the actuator 50 is transferred to rotate the rod 72, which causes the opening and closing of the flapper 52 over the opening separating the first operating volume 14 and the second operating volume 16. When closed, the flapper 52 of the first valve 36 sits against a seat that is disposed on the bottom end of the directing passageway disposed in the first operating volume 14. The second operating volume 16 includes a first flapper 52 cavity that permits the flapper 52 and pivot arm 54 to be maintained therein when the flapper 52 of the first valve 36 is in an open position. The first flapper 52 cavity is designed and shaped such that the flapper 52 and pivot arm 54 of the first valve 36 are completely withdrawn from a total directing passageway, which is the combination of the directing passageways disposing the operating volumes and valve cavities disposed in the second and third operating volume 18 to provide space for the operation of the flappers 52 and 62.

Figure 7A:
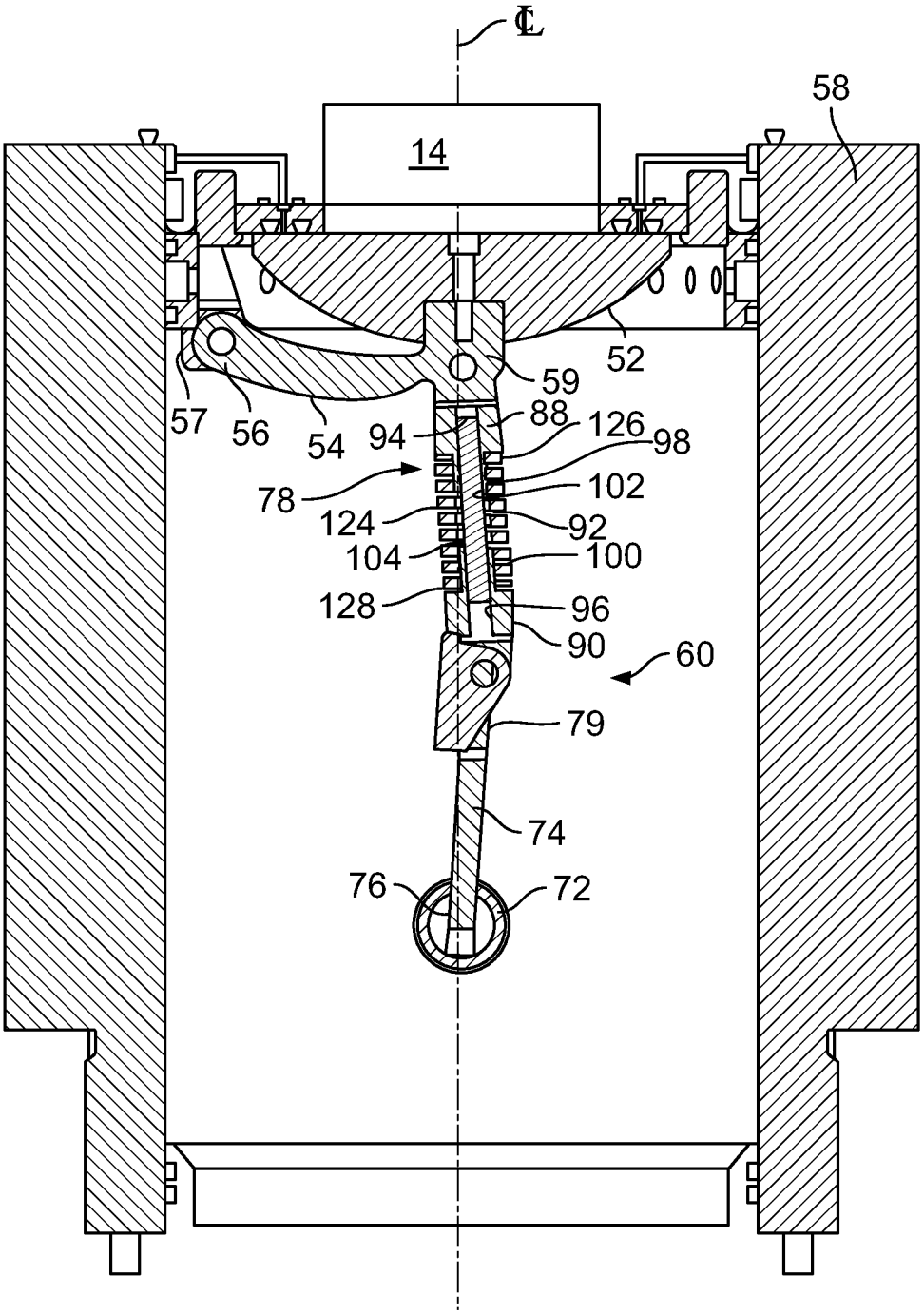
FIGS. 7A-7C are half cross-sectional views of a portion of the example valve assembly of FIG. 3.
Figure 7B:
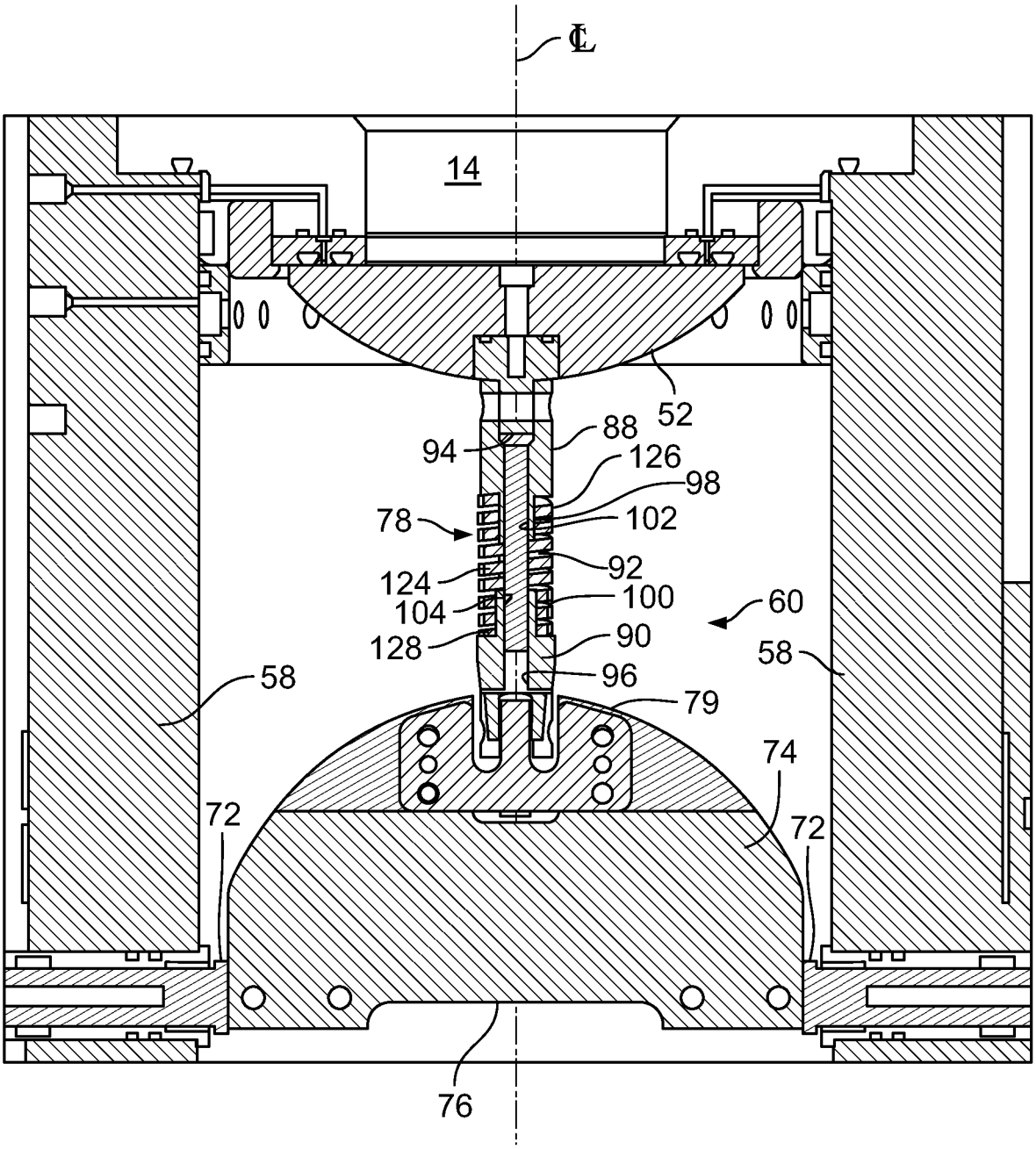
Figure 7C:
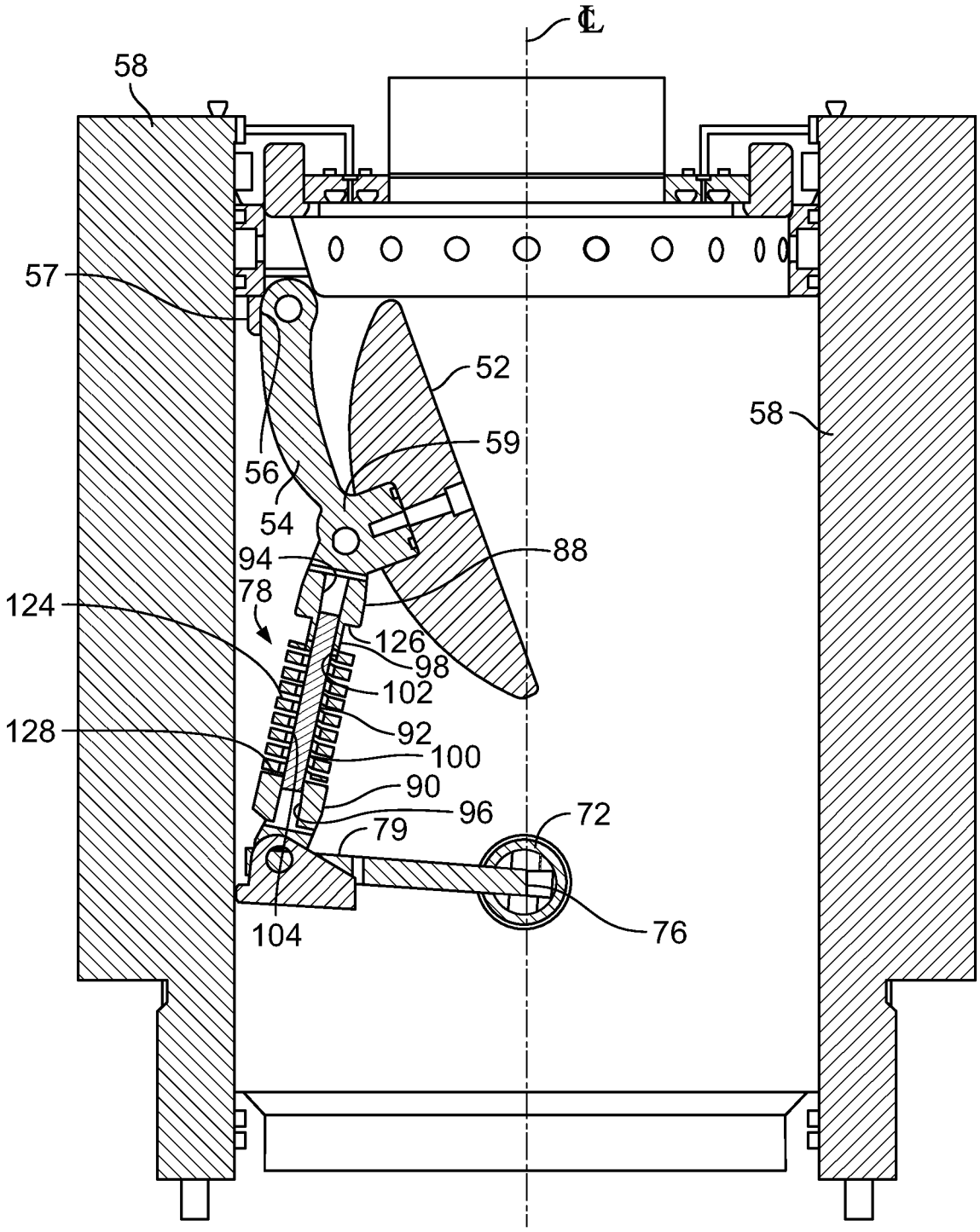

FIGS. 7A-7C are side cross-sectional views of the example valve assembly 10. The linkage assembly 60 includes a rod 72 rotationally disposed in a portion of a valve body 58 of the second operating volume 16 and extending through the valve body 58 to engage with the actuator 50. A planar element 74 is attached to the rod 72 on one end 76 and rotatably attached to an extension assembly 78 on a second end 79 of the planar element 74. The extension assembly 78 is rotatably attached to the flapper 52 on the other end. The extension assembly 78 is designed such that when the planar element 74 is rotated via the rod 72, the extension assembly 78 can extend when the flapper 52 is open and the extension assembly 78 can provide selective compressive force to the flapper 52. In one implementation, the extension assembly 78 can be attached to the rod 72 without the use of the planar element 74.

Figure 8A:
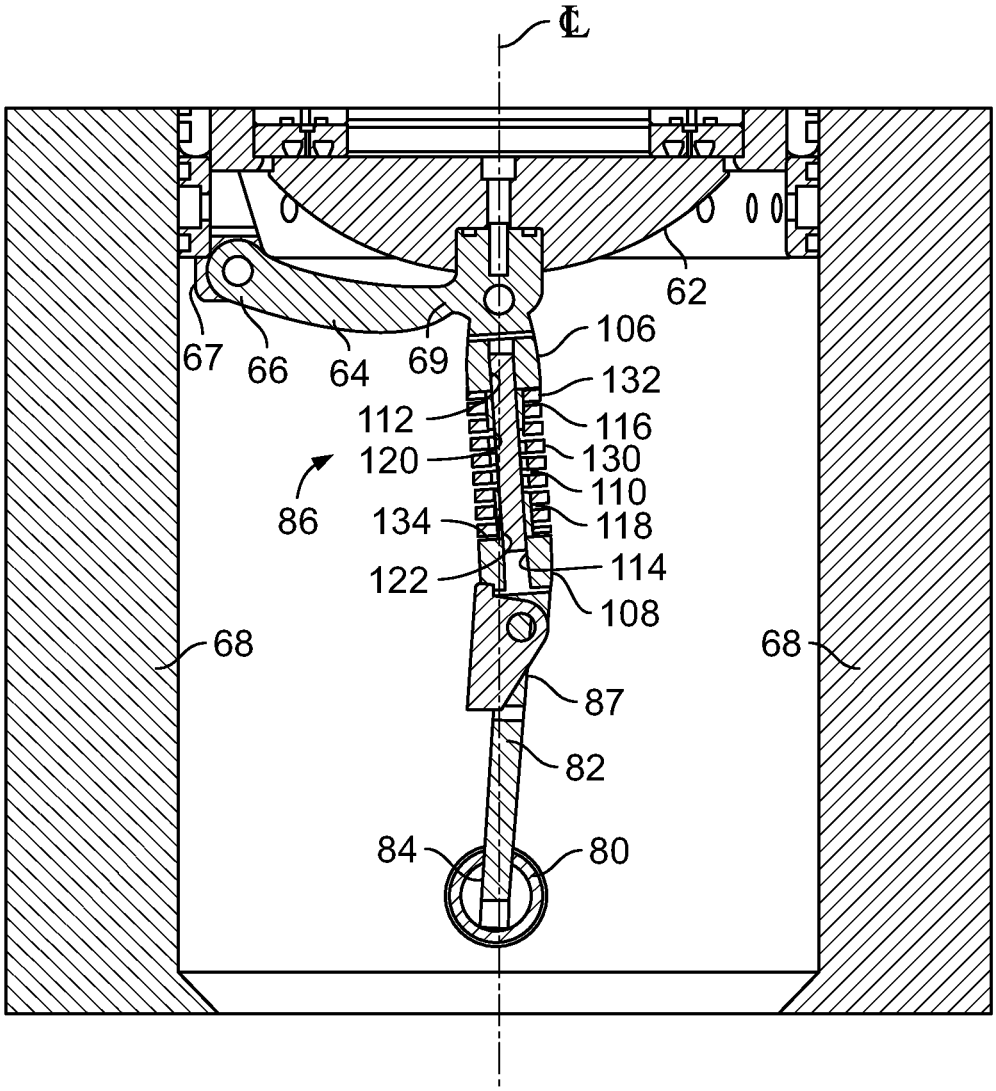
FIGS. 8A-8C are half cross-sectional views of another portion of the example valve assembly of FIG. 3.

In some implementations, such as FIG. 8A, the linkage assembly 70 includes a rod 80 rotationally disposed in a portion of a second valve body 68 (if a dual valve design is used) of the third operating volume 18 and extending through the second valve body 68 to engage with the actuator 50. A planar element 82 is attached to the rod 80 on one end 84 and rotatably attached to an extension assembly 86 on a second end 87 of the planar element 82. The extension assembly 86 is rotatably attached to the flapper 62 on the other end. The extension assembly 86 is designed such that when the planar element 82 is rotated via the rod 80, the extension assembly 86 can extend when the flapper 62 is open and the extension assembly 86 can provide selective compressive force to the flapper 62. In one implementation, the extension assembly 86 can be attached to the rod 80 without the use of the planar element 82.

The extension assemblies 78 and 86 also function to lock the valves 36 and 38 into place when the extension assemblies are rotated to a certain position and the valves 36 and 38 are in the closed position. It is not the rotational force supplied by the actuators 50 that holds the valves 36 and 38 closed. It should be understood and appreciated that the extension assemblies 78 and 86 also experience a tensional force when the actuators 50 cause the opening of the valves 36 and 38 in the manner disclosed herein.

The planar elements 74 and 82 can be any shape and size such that when the actuator 50 rotates the rods 72 and 80 in one direction, the extension assemblies 78 and 86 and the planar elements 74 and 82 cooperate to pull the flappers 52 and 62 open. Conversely, the planar elements 74 and 82 can be any shape and size such that when the actuator 50 rotates the rods 72 and 80 in the other direction, the extension assemblies 78 and 86 and the planar elements 74 and 82 cooperate to push the flappers 52 and 62 closed. In one implementation shown in FIG. 8A, the planar element 82 has an arch shape such that when the valve 38 is opened there is more access to the center portion of the valve assembly 10. It should be understood and appreciated that the planar element 74 can be arched shape as well.

Figure 8B:
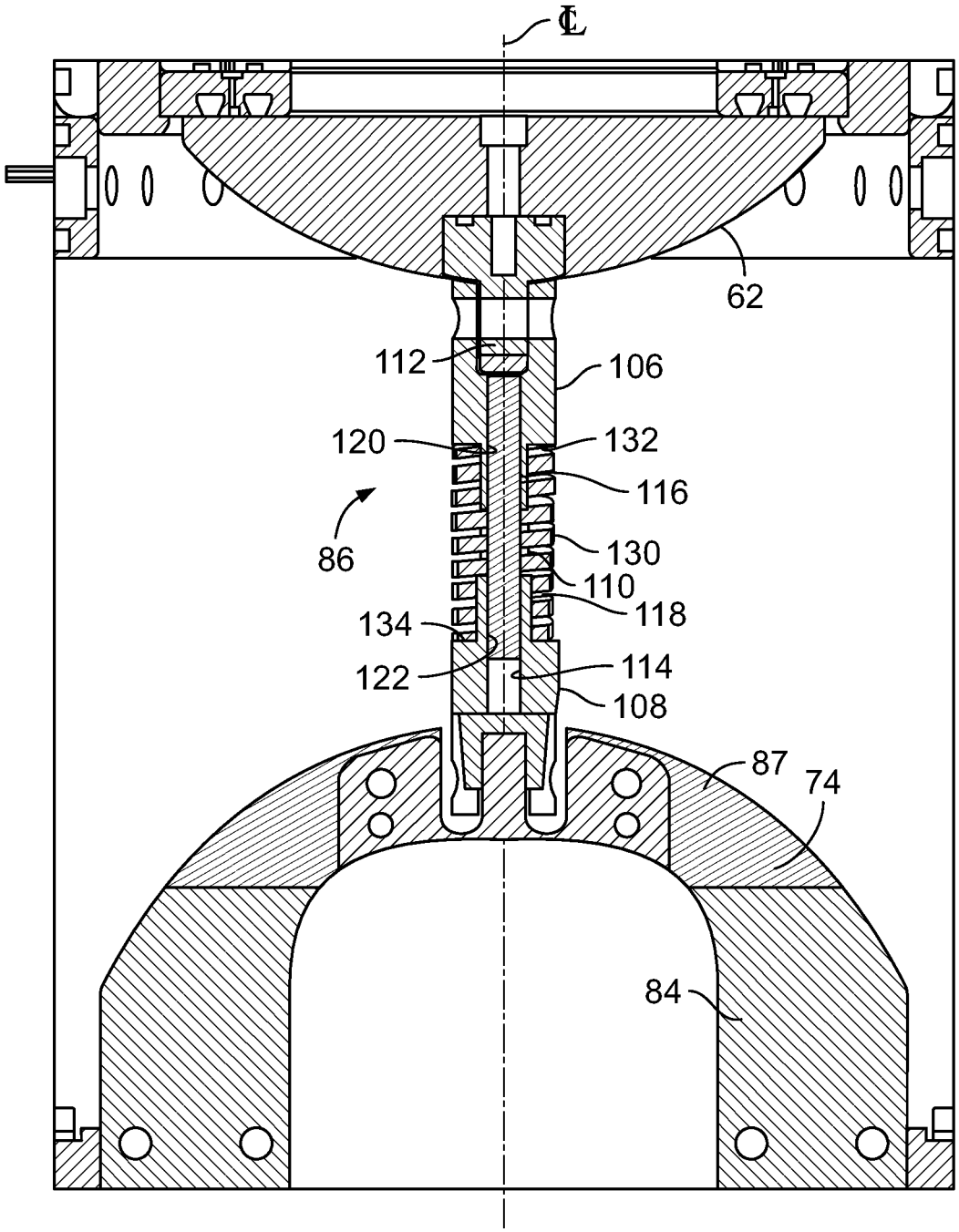
Figure 8C:
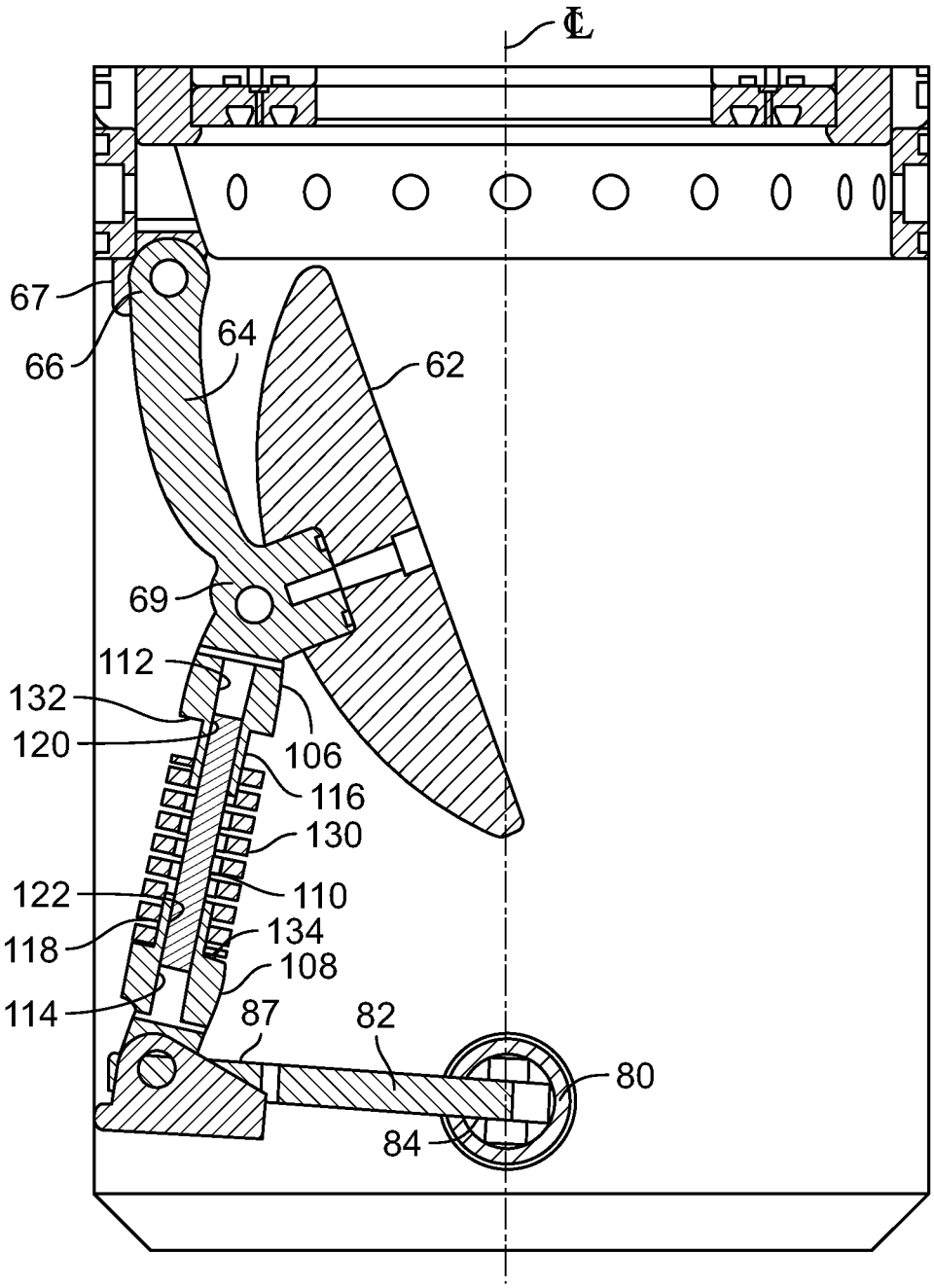

As shown in FIGS. 8B-8C, the second valve 38 includes a flapper 62, and a pivot arm 64 supported on one end to a second rod 80 that is rotationally disposed in the valve body and extends through the valve body. The operation of the actuator 50 is transferred to rotate the second rod 80, which causes the opening and closing of the flapper 62 over the opening separating the second operating volume 16 and the third operating volume 18. When closed, the flapper 62 of the second valve 38 sits against a seat that is disposed on the bottom end of the directing passageway disposed in the second operating volume 16. The third operating volume 18 includes a second flapper 62 cavity that permits the flapper 62 and pivot arm 64 of the second valve 38 to be maintained therein when the flapper 62 of the second valve 38 is in an open position. The second flapper 62 cavity is designed and shaped such that the flapper 62 and pivot arm 64 of the second valve 38 are completely withdrawn from the total directing passageway.

As a safety measure, the selective compressive forces of the extension assemblies 78 and 86 allow the flappers 52 and 62 to open during situations when the pressure of the fluid in the first operating volume 14 and the second operating volume 16, respectively, increases above a certain threshold. The extension assemblies 78 and 86 can be extendable and retractable under certain forces such that the flappers 52 and 62 could be opened in specific scenarios wherein the pressure of the fluid in the first and second operating volumes 14 and 16 increases a certain predetermined amount over the pressure of the fluid in the second and third operating volumes 16 and 18.

In some implementations, as in FIG. 7C, the extension assembly 78 includes a first end portion 88 rotatably attachable to the flapper 52 or the pivot arm 54, a second end portion 90 rotatably attachable to the planar element 74 and a rod 92 slidably disposed within a passageway 94 disposed in the first end portion 88 on one end and slidably disposed within a passageway 96 disposed in the second end portion 90 on the other end of the rod 92. The first end portion 88 has a sleeve portion 98 extending therefrom to receive the rod 92 and the second end portion 90 has a sleeve portion 100 to receive the rod 92. The passageway 94 disposed in the first end portion 88 is in alignment with an internal portion 102 of the sleeve portion 98, and the passageway 96 disposed in the second end portion 90 is in alignment with an internal portion 104 of the sleeve portion 100 to allow the first and second end portions 88 and 90 to slide on the rod 92.

Similarly, as in FIG. 8A, the extension assembly 86 includes a first end portion 106 rotatably attachable to the flapper 62 or the pivot arm 64, a second end portion 108 rotatably attachable to the planar element 82 and a rod 110 slidably disposed within a passageway 112 disposed in the first end portion 106 on one end and slidably disposed within a passageway 114 disposed in the second end portion 108 on the other end of the rod 110. The first end portion 106 has a sleeve portion 116 extending therefrom to receive the rod 110, and the second end portion 108 has a sleeve portion 118 to receive the rod 110. The passageway 112 disposed in the first end portion 106 is in alignment with an internal portion 120 of the sleeve portion 116 and the passageway 114 disposed in the second end portion 108 is in alignment with an internal portion 122 of the sleeve portion 118 to allow the first and second end portions 106 and 108 to slide on the rod 110.

In some implementations, the extension assembly 78 includes a spring 124 disposed around the rod 92, the sleeve portion 98 of the first end portion 88, and the sleeve portion 100 of the second end portion 90. The spring 124 is also disposed between a shoulder 126 disposed on the first end portion 88 and a shoulder 128 disposed on the second end portion 90 of the extension assembly 78. Similarly, the extension assembly 86 includes a spring 130 disposed around the rod 110, the sleeve portion 116 of the first end portion 106 and the sleeve portion 118 of the second end portion 108. The spring 130 is also disposed between a shoulder 132, disposed on the first end portion 106 and a shoulder 134, disposed on the second end portion 108 of the extension assembly 86. The springs 124 and 130 provide additional control of the flappers 52 and 62 when pressure of the fluid above it is increased a certain amount above the fluid disposed below the flapper. In some implementations, the springs 124 and 130 are coil springs.

In some implementations, the rods 72 and 80 of the linkage assemblies can be comprised of more than one component and multiple actuators 50 to permit more efficient rotational force to be applied to planar elements 74 and 82.

In certain instances, the valve assembly 10 can only include a first operating volume 14 and the third operating volume 18 and only one valve 36 or 38 disposed there between. Thus, when used with tethered tools, the valve assembly 10 only requires a single valve 36 or 38. It should be understood that if only the first valve 36 is implemented, then the second and third operating volumes 16 and 18 merge to form a single operating volume. Similarly, if only the second valve 38 is implemented, then the first and second operating volumes 14 and 16 merge to create a single operating volume.

The pressure of the fluid above the first valve 36 and the second valve 38 can spike in certain circumstances. Should this situation occur, the respective actuators are equipped to let the first flapper 52 and/or the second flapper 62 open if the pressure of the fluid above the first flapper 52 and/or the second flapper 62 exceeds some predetermined threshold.

The valve assembly 10 can also include a first access port and a second access port disposed in the valve body adjacent to the first flapper 52 and second flapper 62 cavities, respectively. The first access port and the second access port provide access to the first valve 36 and the second valve 38, respectively, in the case any repairs need to be made.

Figure 9:
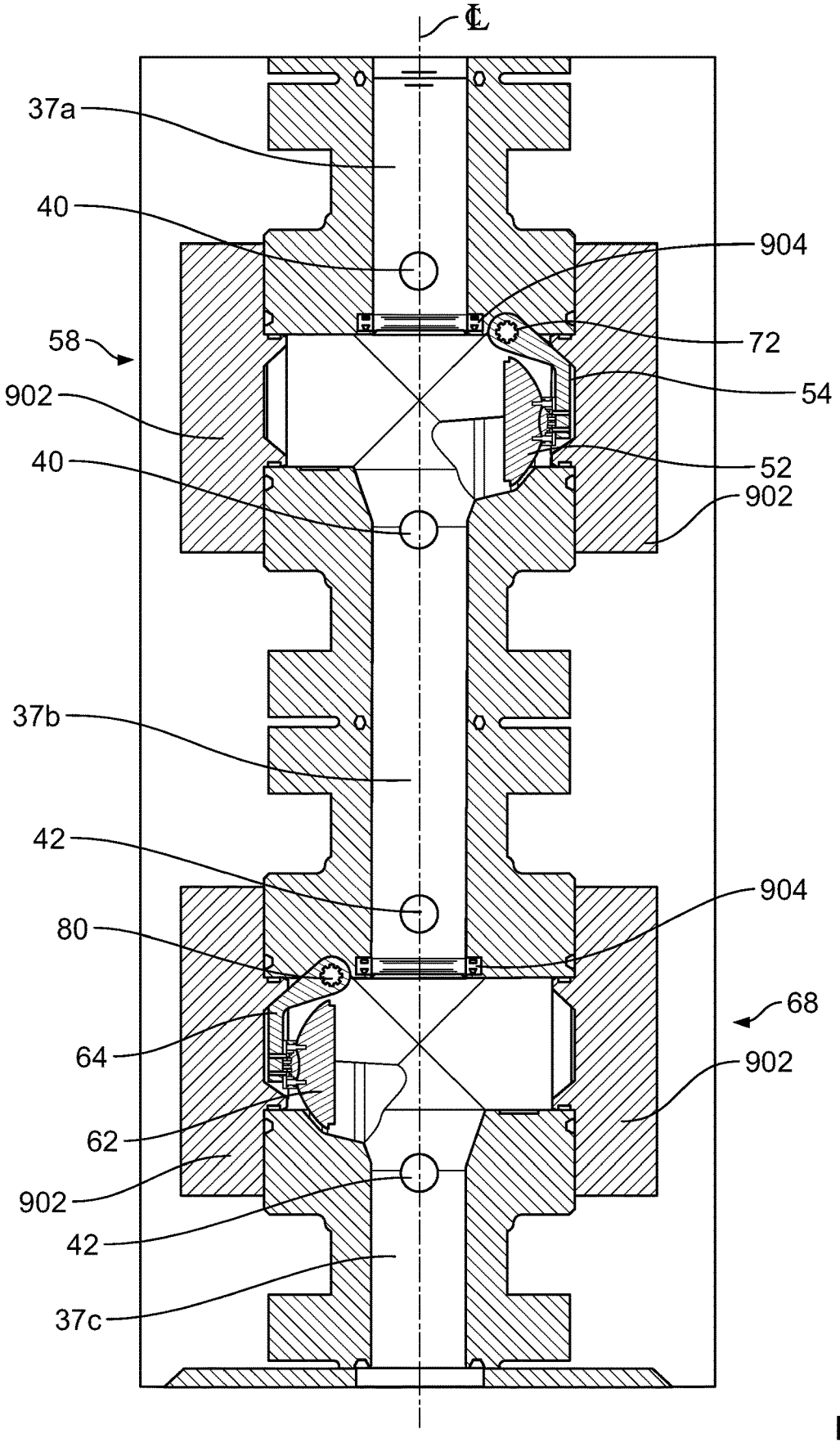
FIG. 9 is a side half-cross-sectional view of another example valve assembly that can be used with aspects of this disclosure.

FIG. 9 is an example side cross-sectional view of an alternate example valve assembly 10. The illustrated example is similar to the valve assembly 10 described above in function and features, except as noted below. It includes a first valve body 58 coupled to a second valve body 68 by a flanged connection. However, in other instances, the valve bodies could be coupled by another type of connection or could be formed as a single, integral one piece unit. The top and bottom of the valve assembly 10 are also flanged to facilitate connecting the valve assembly 10 in-line in the fracturing stack, but other types of connections could be used.

In this example, the valve assembly 10 is a full bore valve. In other words, the main, central bore through the valve is the same dimeter, without intruding obstructions, as the main, central bore through the remainder of the fracturing stack, so that tooling can pass easily through the valve assembly 10 without obstruction.

In the illustrated implementation, the first actuator rod 72 and the second actuator rod 80 are positioned outside of the center bore of the valve assembly. This arrangement enables the flappers 52, 62 and their corresponding pivot arms 54, 64 to retract into corresponding side cavities of the valve assembly 10 when the flappers are open, so as reside completely out of the center bore when open. In this implementation, the first rod 72 and the second rod 80 are directly connected to the first pivot arm 54 and the second pivot arm 64, respectively. The direct connection further provides a compact configuration that facilitates containment of the flappers 52, 62 and pivot arms 54, 64 out of the bore. For ease of construction and maintenance, the valve assembly 10 can include side openings capped by blind flanges 902 sealed and affixed to the valve bodies 58, 68. The blind flanges 902 can be installed and removed easily to facilitate access to the flappers 52, 62 and pivot arms 54, 64 during construction or maintenance. Pressure sensors 37*a*, 37*b* and 37*c* are shown in fluid communication with the operating volumes for measuring the pressure in each operating volume, as well as the pressure differential between operating volumes. Additional or fewer sensors could be provided, as well as sensors of different types.

Metal seals 904 are retained to the valve bodies 58, 68, and form a metal-to-metal seal between the valve bodies 58, 68 and their respective flappers 52, 62 when the flappers are closed. Also, in certain instances, the flappers 52, 62 are coupled to their respective pivot arms 54, 64 in a compliant manner, to allow movement between the flapper and arm. The movement facilitates the flappers 52, 62 seating on the seals 904 as they close.

Figure 10:
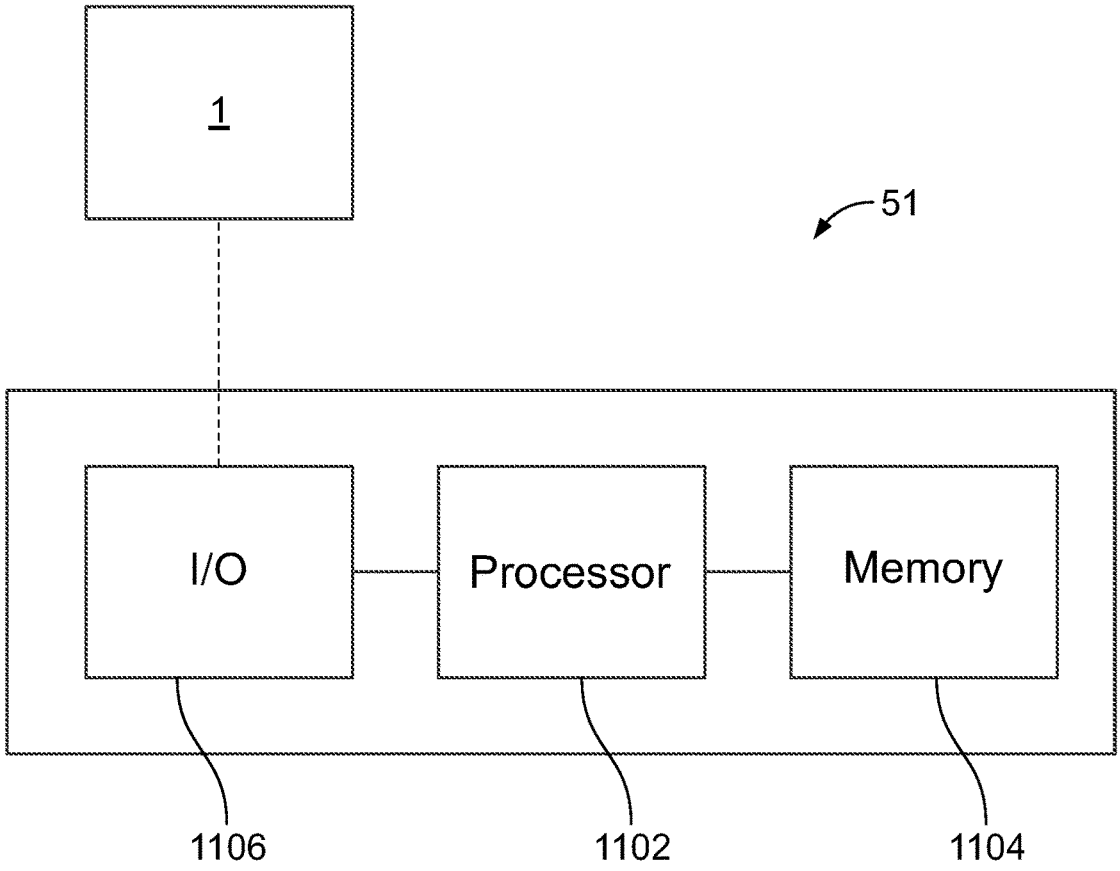
FIG. 10 is a block diagram of a controller that can be used with aspects of this disclosure.

As shown in FIG. 10, the valve assembly 10 can include a controller 51 to, among other things, monitor pressures of the operating volumes and send signals to actuate the equalizing valves 44 and the actuators 50. As shown in FIG. 10, the controller 51 can include one or more processors 1102 and non-transitory storage media (e.g., memory 1104) containing instructions that cause the processors 1102 to perform the methods described herein. The processors 1102 are coupled to an input/output (I/O) interface 1106 for sending and receiving communications with other equipment of the well fracking site 1 (FIG. 1), including, for example, the actuators 50 via communication links 53 (FIG. 3). In certain instances, the controller 51 can additionally communicate status with and send actuation and control signals to one or more of the automated latch 206, the other valves (including main valves 216 and swab valve 212) of the fracturing stack 200, the BOP 204, the lubricator 202 (and its tool trap), any well drop launcher, as well as other sensors (e.g., pressure sensors, temperature sensors and other types of sensors) provided in the fracturing stack 200. In certain instances, the controller 51 can communicate status and send actuation and control signals to one or more of the systems on the well site 1, including the blenders 3, fracking pumps 5 and other equipment on the well site 1. The communications can be hard-wired, wireless or a combination of wired and wireless. In some implementations, the controller 51 can be located on the valve assembly 10. In some implementations, the controller 51 can be located elsewhere, such as in the data van 6, elsewhere on the well site 1 or even remote from the well site 1. In some implementations, the controller can be a distributed controller with different portions located about the well site 1 or off site. For example, in certain instances, a portion of the controller 51 can be located at the valve assembly 10, while another portion of the controller 51 can be located at the data van 6 (FIG. 1).

The controller 51 can operate in monitoring, controlling, and using the valve assembly 10 for introducing a well drop and for allowing the passage of a tool through the valve assembly 10 to the high pressure area. To monitor and control the valve assembly 10, the controller 51 is used in conjunction with transducers (sensors) to measure the pressure of fluid at various positions in the valve assembly 10 and to measure the position of various parts of the valve assembly 10. Input and output signals, including the data from the transducers, controlled and monitored by the controller 51, can be logged continuously by the controller 51.

Figure 11:
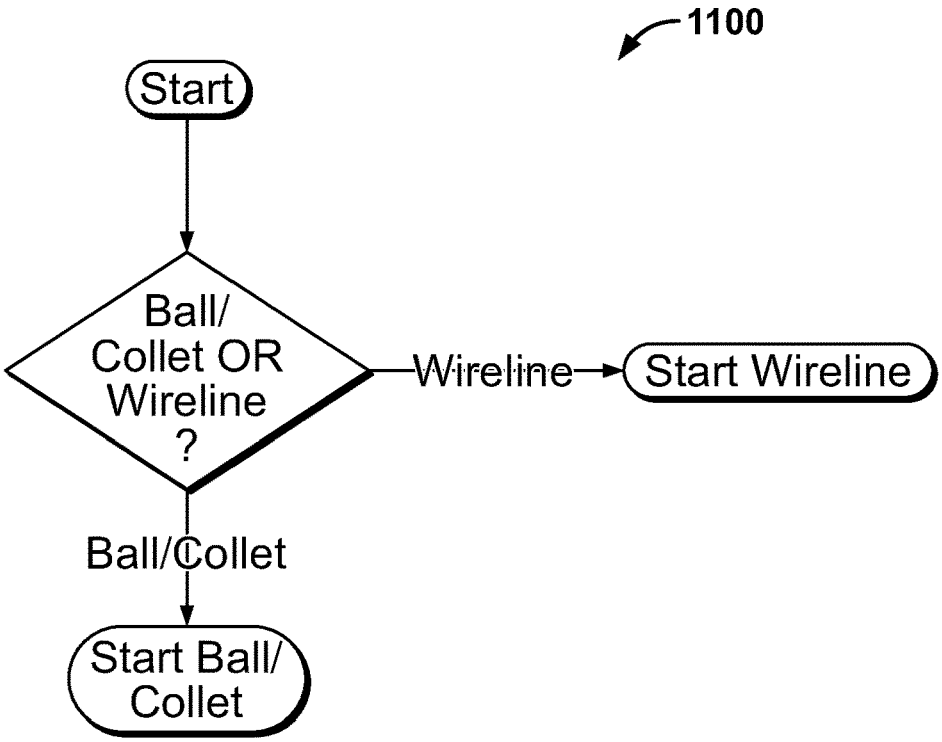
FIG. 11 is an example logic diagram that can be executed by an example controller.

Once the valve assembly 10 is powered up, a determination is made whether a wireline deployed tool sequence is desired or a well drop sequence is desired. The wireline deployed tool sequence would be used when a tool on wireline, such as perforating string or logging string supported on wireline, is passed through the fracking stack 200 into the well 4. A well dropping sequence would be used when a well drop (e.g., frac ball, collet, soap bar or other) is to be dropped through the fracking stack 200 into the well 4. FIG. 11 shows an example logic sequence 1100 that is used by the controller to set which operation to perform. The determination is made based on user input to the controller, for example, through a terminal in communication with the controller. In the event that a wireline deployed tool sequence is desired, then logic sequence 1200 is selected. Notably, the wireline sequence can also be used for running tubing deployed tools. If a well drop sequence is desired, then a logic sequence 1300 is selected. Details of each logic sequence are provided below. The logic sequences 1100, 1200 and 1300 can be stored as executable instructions in the memory 1104 of controller 51.

Figure 12:
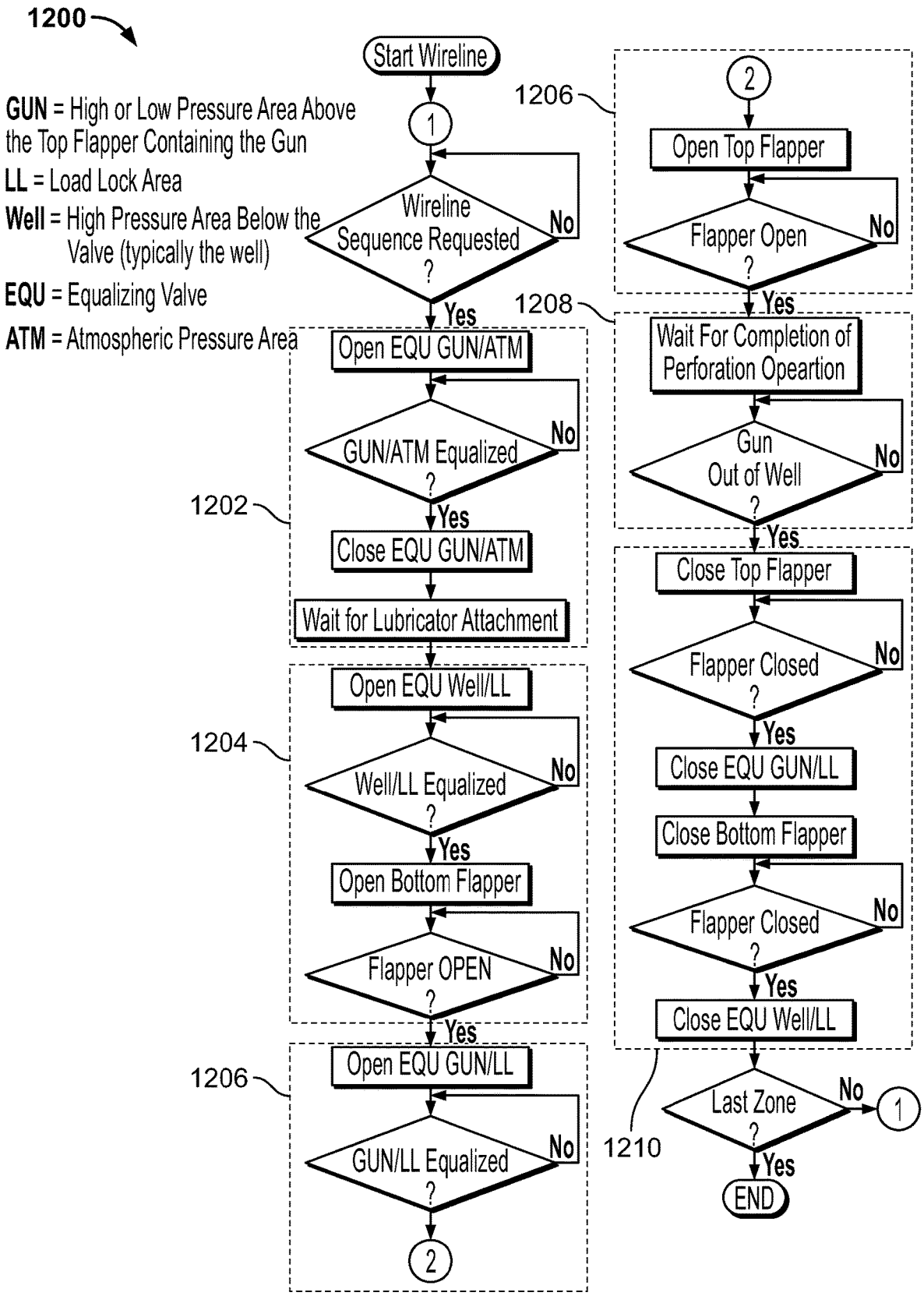
FIG. 12 is an example logic diagram that can be executed by an example controller.

FIG. 12 is a block diagram of an example logic sequence 1200 that can be used by the controller 51 (FIG. 10) when executing wireline operations. In performing the wireline sequence, a lubricator containing the wireline tool string typically has previously been attached above the valve assembly (FIG. 2A). The sequence 1200 can be performed autonomously, without human invention other than to indicate to the controller 51 that certain actions performed apart from controller 51 (e.g., stabbing/retrieving the lubricator) have been completed. If the lubricator needs to be removed, for example to change or repair the tool carried in the lubricator, operation 1202 is performed. In operation 1202, the pressure of the fluid in the first operating volume 14 (FIG. 3) is brought to atmospheric pressure (e.g., absolute atmospheric pressure, actual pressure of the surrounding atmosphere, or to within a specified maximum pressure differential to either). In this context, and in the accompanying diagram, the first operating volume 14 is referred to as an "atmospheric pressure area." The pressure of the fluid in the first operating volume 14 can be determined via a pressure sensor in fluid communication with the first operating volume 14 and coupled to the controller 51. The pressure of the fluid in the first operating volume 14 can be reduced by venting the first operating volume 14 (e.g., by actuating a equalizing valve, as described above) to bleed off pressure. Once it is verified that the pressure of the fluid in the first operating volume 14 is equalized with the atmosphere, the lubricator can be removed, the tool changed or accessed, and the lubricator reinstalled to the fracking stack 200 above the first operating volume 14. Notably, the pressure in the well 4 and the fracking stack 200 below the valve assembly 10 need not be affected, and can remain at fracturing pressure or near to fracturing pressure.

In operation 1204, the second valve 38 is operated. First, the pressure of fluid in the second operating volume 16 (referred to as the "load lock area" in the accompanying diagram) can be determined via a pressure sensor in fluid communication with the second operating volume 16. To open the second valve 38 that separates the second operating volume 16 and the third operating volume 18, the pressure of the fluid in the second operating volume 16 has to be within the specified maximum pressure differential to the third operating volume 18, which essentially equalizes the second operating volume 16 and third operating volume 18. The third operating volume 18 is open to the well 4, and thus is at well pressure. If the pressure differential is greater than the specified maximum pressure differential, the pressure of the fluid in the second operating volume 16 has to be increased to be essentially equal (i.e., within the specified maximum pressure differential wherein the second valve 38 will open) to the pressure of the fluid in the third operating volume 18.

To increase the pressure of the fluid in the second operating volume 16, the equalizing valve associated with the first conduit 42 connecting the second operating volume 16 and the third operating volume 18 can be opened and the pressure of the fluid in the third operating volume 18 flows into the second operating volume 16 and increases the pressure of the fluid in the second operating volume 16 to the specified maximum pressure differential of the fluid in the third operating volume 18. Once the pressure of the fluids in the second operating volume 16 and the third operating volume 18 are equalized, the second valve 38 separating these two operating volumes can be opened.

Once the second valve 38 separating the second operating volume 16 and the third operating volume 18 is opened, the first valve 36 will need to be opened to allow the tool string to be extended through the valve assembly 10 (operation 1206). To open the first valve 36, the pressure of the fluid in the first operating volume 14 and the second operating volume 16 is brought to within the specified maximum pressure differential wherein the first valve 36 is capable of opening. If the pressure of the fluid in the second operating volume 16 is greater than the pressure of the fluid in the first operating volume 14, the pressure of the fluid in the first operating volume 14 has to be increased to be essentially equal (or within a certain range wherein the first valve 36 will open) to the pressure of the fluid in the second operating volume 16. In another implementation, the pressure of the fluid in first operating volume 14, the second operating volume 16, and the third operating volume 18 can be brought to within a certain range and the first valve 36 and second valve 38 can then be opened. The first and second valve 36 and 38 can be opened at the same time, or near the same time, to permit the tool string to extend through the valve assembly 10 and into the well.

To increase the pressure of the fluid in the first operating volume 14, the equalizing valve associated with the second conduit 40 connecting the first operating volume 14 and the second operating volume 16 can be opened and the pressure of the fluid in the second operating volume 16 flows into the first operating volume 14 and increases the pressure of the fluid in the first operating volume 14 to be essentially equal to the pressure of the fluid in the second operating volume 16. Once the pressure of the fluids in the first operating volume and the second operating volume 16 are equalized, the first valve 36 separating the first operating volume 14 and the second operating volume 16 can be opened. In another implementation, a third conduit fluidically connecting the first operating volume 14 and the third operating volume 18, and a corresponding equalizing valve could be used to permit the fluid in the third operating volume 18 be used to increase the pressure of the fluid in the first operating volume 14.

It should be understood that for wireline sequences, the second valve 38 separating the second operating volume 16 and the third operating volume 18 can be started out as open and left open for the duration of the operation to equalize the pressure of the fluid in the valve assembly 10.

Once the second valve 38 separating the second operating volume 16 and the third operating volume 18 and the first valve 36 are opened, the fluid in the valve assembly 10 is equalized and the lubricator can feed the tool string into and through the valve assembly 10 to perform any desired operation in the well (operation 1208). After the conclusion of the operation being performed via the tool string, the tool string can be withdrawn from the well and the valve assembly 10. In operation 1210, the first valve 36 can then be closed and the equalizing valve associated with the second or third conduit, depending on which conduit was used to equalize the first operating volume 14, can be closed. The second valve 38 separating the second operating volume 16 and the third operating volume 18 can then be closed. The equalizing valve associated with the first equalizing conduit 42 can be closed after the second valve 38 is closed.

The opening and closing of the first valve 36 that separates the first operating volume 14 and second operating volume 16 and the second valve 38 that separates the second operating volume 16 and third operating volume 18 can be verified via a valve position sensor (can be the same valve position sensor or separate valve position sensors) in communication with the controller.

The process can be repeated. If no other operations are to be performed, the wireline sequence is terminated. If the wireline sequence is terminated, the pressure of the fluid in the first operating volume 14 can be decreased to atmospheric pressure venting the first operating volume 14 to bleed pressure from the first containment.

Figure 13:
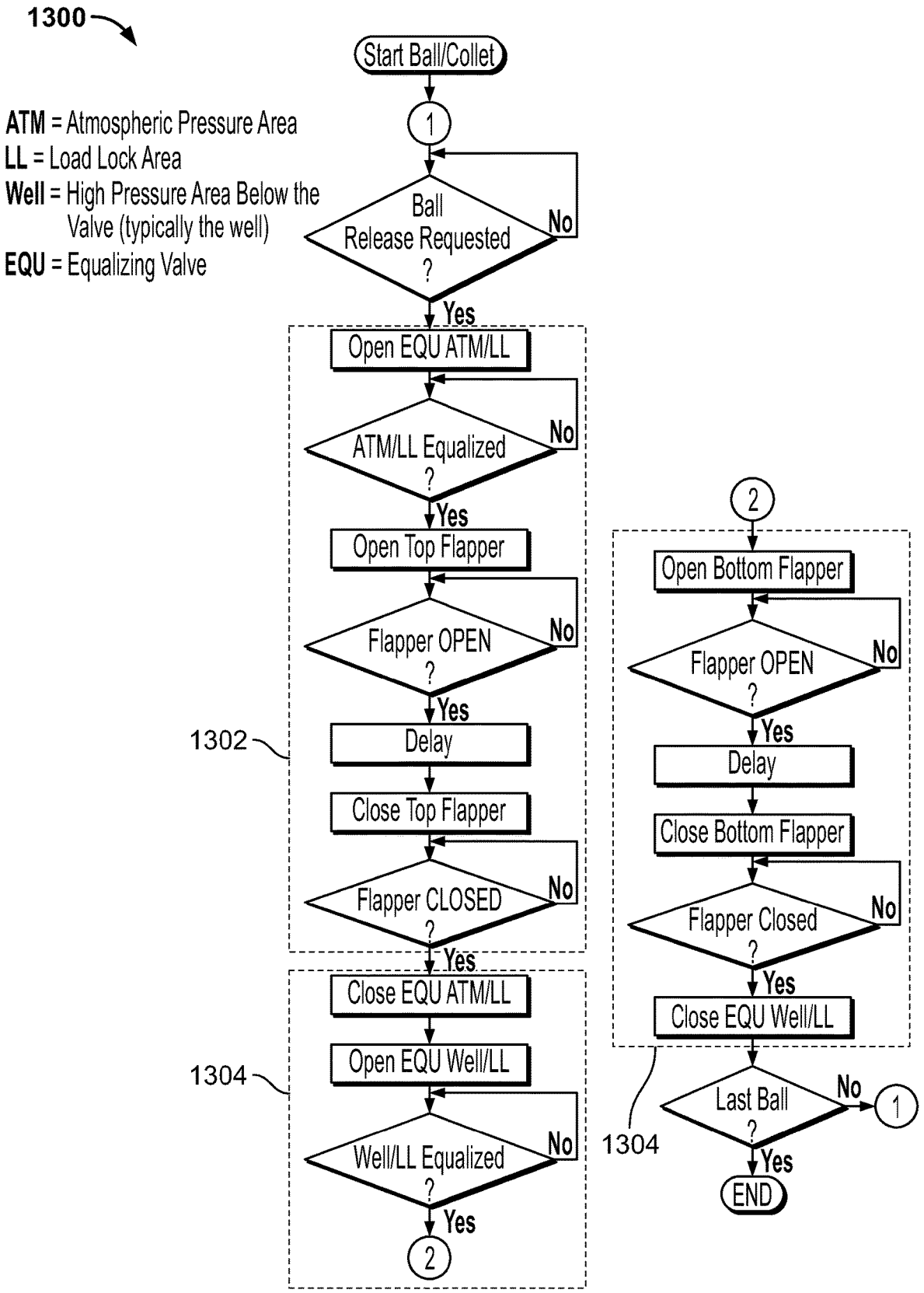
FIG. 13 is an example logic diagram that can be executed by an example controller.

FIG. 13 is a block diagram of an example logic sequence 1300 that can be used by the controller 51 to execute well drop operations, for example, dropping a frac ball or collet down the well. As with sequence 1200, sequence 1300 can be performed autonomously, without human intervention other than to indicate to the controller 51 that certain actions performed apart from controller 51 (e.g., placing the well drop) have been completed. If it is determined the logic sequence 1300 is desired, the valve assembly 10 is given the command via the controller to perform the logic sequence 1300. When it is desirable to conduct the logic sequence 1300, the well drop 12 to be released will be positioned in the first operating volume 14 and operation 1302 performed. To open the first valve 36, the pressure of the fluid in the second operating volume 16 has to be within a certain range of the pressure of the fluid in the first operating volume 14, which essentially equalizes the first and second operating volumes 14 and 16. The pressure of the fluid in the first operating volume 14 can be determined via a pressure sensor if the pressure of the fluid is not known to be atmospheric. Pressure of fluid in the second operating volume 16 can be determined via a pressure sensor coupled to the second operating volume 16.

The pressure of the fluid in the second operating volume 16 can be reduced by opening the corresponding equalizing valve to the second conduit 40 that fluidically connects the second operating volume 16 and the first operating volume 14. Once the pressure of the fluid in the first operating volume 14 and the second operating volume 16 equalizes, the first valve 36 can then be opened by the controller 51. The controller 51 will not send the signal to open the first valve 36 until the equalization occurs between the first operating volume 14 and the second operating volume 16. The equalizing valve can remain open until the equalization occurs and then be closed before or during the opening of the first valve 36 or the vent port or second conduit 40 can remain open during the opening and closing of the first valve 36.

The well drop 12 will fall from the first operating volume 14 into the second operating volume 16 once the first valve 36 is opened. Confirmation of the well drop 12 having fallen into the second operating volume 16 can be verified by an well drop 12 detection sensor that can confirm the presence of the well drop 12 in the second operating volume 16. After a specified amount of time (delay) or detection of the well drop 12 in the second operating volume 16, the first valve 36 will close. The closure of the first valve 36 can be verified via a valve position sensor in communication with the controller 51. Once it has been verified that the first valve 36 has been closed, the vent port or the second conduit 40 can be closed if the vent port or the second conduit 40 was left open during the operation of the first valve 36.

The well drop 12 to be released is then passed into the third operating volume 18 (operation 1304). Pressure of fluid in the third operating volume 18 can be determined via a pressure sensor coupled to the third operating volume 18. To open the second valve 38, the pressure of the fluid in the third operating volume 18 has to be within a certain range of the pressure of the fluid in the second operating volume 16, which essentially equalizes the second operating volume 16 and the third operating volume 18. The pressure of the fluid in the second operating volume 16 can be determined via the pressure sensor used to determine the pressure of the fluid in the second operating volume 16.

The pressure of the fluid in the second operating volume 16 can be increased by opening the first conduit 42 via the equalizing valve associated with the first conduit 42. The first conduit 42, when opened, allows the pressure of the fluid in the third operating volume 18 to flow there through and increase the pressure of the fluid in the second operating volume 16. Once the pressure of the fluid in the second and third operating volumes 16 and 18 equalizes, the second valve 38 can then be opened by the controller. The controller will not send the signal to open the second valve 38 until the equalization occurs between the second operating volume 16 and the third operating volume 18. The first conduit 42 can remain open until the equalization occurs and then be closed before or during the opening of the second valve 38 or the first conduit 42 can remain open during the opening and closing of the second valve 38.

The well drop 12 will fall from the second operating volume 16 into the third operating volume 18 once the second valve 38 is opened. Confirmation of the well drop 12 having fallen into the third operating volume 18 can be verified by the well drop 12 detection sensor disclosed herein or a separate well drop 12 detection sensor that can determine the location of the well drop 12 in the third operating volume 18. After a certain amount of time or detection of the well drop 12 in the third operating volume 18, the second valve 38 will close. The closure of the second valve 38 can be verified via a valve position sensor (can be the same valve position sensor disclosed herein or a separate valve position sensor) in communication with the controller 51. Once it has been verified that the second valve 38 has been closed, the first conduit 42 can be closed if the first conduit 42 was left open during the operation of the second valve 38.

After the well drop 12 is passed into the third operating volume 18 (or well), a determination of whether another well drop 12 will be passed into the third operating volume 18 is made. If no further well drop 12 is to be passed into the third operating volume 18, the logic sequence 1300 is terminated. If an additional well drop 12 is to be passed into the third operating volume 18, another well drop 12 is positioned in the first operating volume 14 and the logic sequence 1300 is recommenced.

The concepts described herein can, in certain instances, yield a number of advantages. For example, due to the valve assembly's ability to prevent damage to the tool strings and their associated wireline or tubing (e.g., the perforating string), there should be no downtime fishing for lost tools. The operations can manifest a significant time, and thus cost, savings because, in multistage fracking operations, the majority of the fracking stack and the surface equipment, including the fracking equipment on the well site, need not be pressured up and down with each fracturing stage to enable interchanging the perforating string and well drop. Furthermore, pressure testing between fracturing stages can be reduced or eliminated. Cost savings can be had in fuel/energy, operator and equipment costs that would otherwise have been incurred in pumping the well and such a large volume of the fracking stack and surface equipment up to pressure, both for pressure testing and pressurizing back up to fracturing pressure in performing the next fracturing stage. Savings due to wear on equipment can also be realized, as the maintenance (e.g., repair of worn parts and greasing) on the valves below the valve assembly and within the surface equipment is reduced, since these valves can be operated fewer times during the fracturing operations. Finally, savings can be realized in reduction of non-productive operator time associated with repairing leaks that can occur from pressurizing/depressurizing multiple valves and lines of the surface equipment with each fracturing stage.

A number of implementations of the invention have been described. Nevertheless, it will be understood that various modifications may be made without departing from the spirit and scope of the invention. For example, valves other than flappers may be used without departing from this disclosure. Accordingly, other implementations are within the scope of the following claims.

What is claimed is:

1. A method, comprising:

while a fracturing stack on a well is at fracturing pressure, receiving a perforating string in a section of the center bore of the fracturing stack, the section being above a fracturing head of the fracturing stack;

while the fracturing stack is at fracturing pressure, sealing the section of the center bore to maintain fracturing pressure in and below the fracturing head;

equalizing pressure in the section to atmospheric pressure;

receiving, at atmospheric pressure, a well drop in the section;

equalizing pressure in the section to the pressure in the fracturing stack below the section; and releasing the well drop into the center bore of the fracturing head and to the well.

2. The method of claim 1, where sealing the section of the fracturing stack above the fracturing head comprises closing a flapper valve above the fracturing head.

3. The method of claim 2, comprising sealing the section from atmospheric pressure by closing a second flapper valve above the first mentioned flapper valve.

4. The method of claim 3, where releasing the well drop into the center bore of the fracturing head comprises opening the second flapper valve.

5. The method of claim 4, where closing the flapper valve, closing the second flapper valve and opening the second flapper valve are each responsive to communications from a controller; and opening the second flapper valve comprises confirming, by the controller, that a pressure differential between the section and below the second flapper valve is no more than a maximum specified pressure differential.

6. The method of claim 2, before receiving the perforating string in the section, sealing the section of the fracturing stack above the fracturing head and maintaining the seal while a lubricator comprising the perforating string is received above the section and while a portion of the fracturing stack comprising the section is pressure tested.

7. The method of claim 6, where opening the flapper valve comprises opening the flapper valve in response to a communication from a controller communicably coupled to the flapper valve; and comprising operating a latch to open and receive the lubricator and to latch to the lubricator in response to a communication from the controller.

8. The method of claim 7, comprising maintaining the latch latched in response to the flapper valve being open.

9. The method of claim 2, comprising in response to an obstruction in the center bore of the fracturing stack, ceasing closing the flapper valve prior to severing the obstruction.

10. The method of claim 1, comprising, after perforating has been performed on the well using the perforating string, receiving the perforating string in the section;

while the fracturing stack is at fracturing pressure, again sealing the section to maintain fracturing pressure in and below the fracturing head;

again equalizing pressure in the section to atmospheric pressure; and presenting an upward opening of the center bore of the section of the fracturing stack to the environment around the exterior of the fracturing stack.

11. The method of claim 1, after equalizing pressure in the section to atmospheric pressure, presenting an upward opening of the center bore of the section of the fracturing stack to the environment around the exterior of the fracturing stack; and where receiving, at atmospheric pressure, the well drop in the section comprises receiving the well drop through the upward opening of the center bore.

12. The method of claim 1, where equalizing the pressure in the section to the pressure in the fracturing stack below the section comprises opening a passage, separate from the center bore, between the section and the fracturing stack below the section.

13. The method of claim 1, comprising:

sealing the center bore above the section;

equalizing pressure in the center bore above the section to atmospheric pressure; and removing a lubricator comprising the perforating string from the fracturing stack.

14. The method of claim 1, where equalizing pressure in the section to the pressure in the fracturing stack below the section comprises:

sealing the section of the center bore from a second section of the center bore; and equalizing pressure in the first mentioned section to the pressure in the center bore of the fracturing stack containing the fracturing head while maintaining the pressure in the second section at atmospheric pressure.

15. The method of claim 1, where sealing the second of the center bore to maintain fracturing pressure in and below the fracturing head comprises sealing the section of the center bore with a first seal and sealing the section of the center bore with a second, redundant seal.

16. The method of claim 15, where the first seal comprises a flapper valve oriented to open into a first operating volume below the section and the second seal comprises a flapper valve oriented to open into a second operating volume below the first operating volume and above the fracturing head.

17. The method of claim 1, further comprising communicating pressure from the center bore below the section into the section while maintaining the sealing of the section of the center bore that maintains fracturing pressure in and below the fracturing head.

18. A fracturing stack, comprising:

a fracturing head;

a valve assembly above the fracturing head, the valve assembly comprising:

a body defining a central bore;

a first valve actuable to seal the central bore;

a second valve actuable to seal the central bore;

a first passage between a volume of the center bore above the first valve and the volume of the center bore between the first and second valves; and a second passage between the volume of the center bore between the first and second valves and a volume of the center bore below the second valve; and a lubricator above the valve assembly.

19. The fracturing stack of claim 18, comprising a latch coupling the lubricator to the valve assembly, the latch actuable in response to a signal to release the lubricator.

20. The fracturing stack of claim 18, comprising a controller coupled to the valve assembly, the controller configured to actuate the first valve or the second valve in response to at least two of the pressure in the volume of the center bore above the first valve, the pressure in the volume of the center bore between the first and second valves, or the pressure in the volume of the center bore below the second valve.

21. The fracturing stack of claim 18, where the first valve and the second valve are both flapper valves, the first valve oriented to open into the volume of the center bore between the first and second valves and the second valve oriented to open into the volume of the center bore below the second valve.

22. The fracturing stack of claim 18, comprising a well drop in the volume of the center bore above the first valve.

23. A method, comprising:

while a fracturing stack according to claim 18 is on a well, opening a top section of the fracturing stack center bore to atmospheric pressure without changing pressure in the center bore below the section from well pressure;

removing a lubricator from the top section of the fracturing stack while the top section is at atmospheric pressure; and introducing, at atmospheric pressure, a well drop into the top section and releasing the well drop into the well without changing pressure in the section below from well pressure.

24. The method of claim 23, comprising removing the lubricator from the fracturing stack while the top section is at atmospheric pressure.

25. The method of claim 23, comprising sealing the central bore through the fracturing stack to isolate the top section from the section below;

installing the lubricator to the top section of the fracturing stack; and after installing the lubricator, equalizing the top section to well pressure.

* * * * *